United States Patent [19]

Hayashi et al.

[11] 4,347,924

[45] Sep. 7, 1982

[54] CONTROL SYSTEM FOR A VENDING MACHINE

[75] Inventors: Yukichi Hayashi; Masayuki Tamara; Osamu Sugimoto, all of Sakado; Masayoshi Takizawa, Kitamoto; Tatsujiro Nishioka, Yokohama, all of Japan

[73] Assignee: Nippon Coinco Co. Ltd., Tokyo, Japan

[21] Appl. No.: 189,988

[22] Filed: Sep. 23, 1980

Related U.S. Application Data

[63] Continuation of Ser. No. 26,497, Apr. 3, 1979, abandoned, and a continuation-in-part of Ser. No. 790,507, Apr. 25, 1977, abandoned.

[30] Foreign Application Priority Data

Apr. 30, 1976 [JP] Japan ..... 51-49623

[51] Int. Cl.[3] ..... G07F 5/24

[52] U.S. Cl. ..... 194/1 N; 133/2

[58] Field of Search ..... 194/1 R, 1 N, 2, 9, 194/10; 133/1 R, 2, 3 R, 4 R, 4 A, 5 R, 8 R; 235/92 CN

[56] References Cited

U.S. PATENT DOCUMENTS

| | | | |
|---|---|---|---|
| 3,894,220 | 7/1975 | Levasseur | 194/1 N X |
| 3,896,915 | 7/1975 | Hayashi et al. | 194/1 N |
| 3,948,279 | 4/1976 | Gupta | 133/1 R |
| 3,963,035 | 6/1976 | Levasseur | 133/2 |

*Primary Examiner*—Stanley H. Tollberg
*Attorney, Agent, or Firm*—Ladas & Parry

[57] ABSTRACT

The control system for a vending machine according to the invention is designed for preventing shortage of change coins to a maximum possible extent. According to the control system, as many coins of a low denomination as possible among coins inserted by a purchaser are collected for use as change coins. The control system further includes, in addition to main tubes to which inserted coins are automatically supplemented, auxiliary tubes to which coins are manually supplemented by a supervisor of the vending machine. A payout control between the main tubes and the auxiliary tubes is effected without providing a special switch for detecting change over between the main tubes and the auxiliary tubes.

11 Claims, 5 Drawing Figures

COIN INSERTION
1
COIN DETECTOR
2
CLASSIFYING MECHANISM
3
MANUAL SUPPLY
50 YEN
4
10YEN
100 YEN
7
8
10
5
6
9
(A)
MAIN
TUBE
(B)
MAIN
TUBE
(C)
AUX.
TUBE
(D)
AUX.
TUBE
ESCROW
DEVICE
COLLECTION
36
Mo2
MOTOR
(141)
(142)
MOTOR
Mo1
RETURN
143
12
13
195
14
150
COIN PAY OUT

Se
PU
50
Ve
MN
TO FIG.4
FROM FIG.4
RA
RB
RC
RAN
RBN
K=0
CB

CONTROL SYSTEM FOR A VENDING MACHINE

This application is a continuation of our application Ser. No. 26,497 filed Apr. 3, 1979 (abandoned) and a continuation-in-part of our application Ser. No. 790,507 filed Apr. 25, 1977 (abandoned).

BACKGROUND OF THE INVENTION

This invention relates to a control system for a vending machine.

In a vending machine of a conventional type, a "shortage of change" display is conducted in case the amount of stored change becomes less than a predetermined amount, which is normally determined as a maximum required amount of change such, for example, as 90 yen, for the purpose of preventing an impossibility of paying out change to a purchaser.

The prior art method of detecting "shortage of change" uses an arrangement of a coin detection switch such as an empty switch located at a predetermined position of a change coin storage tube such as normally in the vicinity of a position which corresponds to the maximum required amount of change, for detecting "shortage of change" on the basis of the output of this switch.

One of the important factors for improving the vending efficiency of the vending machine is prevention of "shortage of change" to a maximum degree so as to always maintain the vending machine in a state in which it is capable of vending articles stored therein.

This factor is particularly important for a vending machine which has recently been developed that can handle a large amount of money for a single purchasing or vending operation. More particularly, such a new type of vending machine functions to continuously vend a plurality of articles upon selection by a purchaser in a single vending operation starting by insertion of coins by the purchaser and ending by depression of a clear button (or switch). As a result, a total vending price becomes a large amount and, accordingly, a total amount of the inserted coins becomes a large one.

It is probable that the larger the amount of money required for purchasing the article in the machine becomes the larger becomes the amount of change to be paid out or money to be returned upon cancellation of purchase of the article. Accordingly, there may frequently occur a "shortage of change" state unless a sufficient consideration is given to the aforementioned point in designing the vending machine.

It has recently been proposed to provide an auxiliary coin storage device specifically for paying out coins, which device will hereinafter be called an "auxiliary tube", for the purpose of ensuring provision of a sufficient amount of change coins.

The conventional vending machine originally had only a single coin storage tube as a change or payout coin storage device, which will hereinafter be called a "main tube", to which coins inserted by a purchasers are automatically supplied. The proposed method intends to sufficiently obtain change coins by additionally providing an auxiliary tube specifically for paying out coins manually supplied by a supervisor of the vending machine. A difficulty is found in this vending machine as to a method of detecting "shortage of change" with respect to the main and auxiliary tubes, and there has not yet been proposed an effective means for such detection. One may consider, for example, a method of attaching respectively the aforesaid empty switches to the main and auxiliary tubes. As the number of the main and auxiliary tubes increases, the number of the empty switches also increases. This not only increases cost, but requires a large space for mounting a large number of switches, resulting in bulkiness of the coin acceptor of the machine. Furthermore, if the aforementioned empty switches are provided at respective coin storage tubes, a coin payout operation is prevented when the amount of stored coins falls below the position of each switch, and accordingly, all vending operaions of the machine requiring payout of change are prohibited in a state wherein coins falling short of the predetermined amount are retained in the respective tubes. Since the total amount of the coins retained in the main and auxiliary tubes sometimes becomes such that it will be sufficient to pay out the change, this method is extremely inefficient in that the vending operation is stopped notwithstanding that change can be paid out.

Another difficulty takes place in a case where an auxiliary tube specifically for paying out coins is employed. That concerns a change over control between the coin payout tubes, i.e. control of when the main tube is to be changed over to the auxiliary tube or vice versa for paying out coins.

There has heretofore been proposed a method of providing a switch for detecting a switched position of the tubes to the main tube side in addition to the empty switch. If the number of stored coins in the main tube falls below the position of this switch for detecting the switching position, the switch becomes OFF so as to switch the tube for paying out the coins from the main tube to the auxiliary tube.

However, this method has a disadvantage that it requires a space for mounting the switch for detecting the switched position, and also has an additional disadvantage that as the number of tubes increases, the number of the switches for detecting the switched position of the tubes increases.

SUMMARY OF THE INVENTION

It is, therefore, an object of the invention to provide a novel and useful control system for a vending machine which has eliminated the above described disadvantages of the prior art vending machine and is capable of preventing occurrence of "shortage of change".

It is another object of the invention to provide a control system for a vending machine which can collect as many coins of small denominations to be stored for change as possible from among coins inserted by the purchaser upon collection of the amount of money required for vending the article from the inserted coins, which will hereinafter be called "collected money". More particularly, change is paid out in a combination of coins of denominations including as many coins of higher denominations as possible within a range of combination of the coins inserted by the purchaser. More coins of lower denominations to be used for change are collected in the machine according to the collected money control system of this invention. That is, more coins for change are automatically supplied to the main tube in the machine to prevent "shortage of change" to a maximum possible degree.

It is another object of the invention to provide a control system for a vending machine which can control switching of the payout tube between main and auxiliary tubes without provision of a particular switch for detecting changeover of the tubes and which can effectively detect "shortage of coins" (with only one empty switch provided in a single main tube for coins of a minimum denomination) without provision of empty switches in the other main and auxiliary tubes.

According to the "collected money" control system of this invention, there are provided "inserted coin counting circuits" for counting the number of inserted coins of respective denominations (such, for example, as 10 yen, 50 yen and 100 yen coins) and the count of the inserted coin counting circuit for the inserted coins of lower denominations, preferably the minimum denomination such as 10 yen, is compared with a set vend price of an article selected by the purchaser. When the count of the inserted minimum denomination coin counting circuit has not reached the set vend price, the amount of one coin of a denomination which is one rank higher than the minimum denomination hereinafter referred to an an intermediate denomination, e.g., 50 yen, is added to the count of the inserted minimum denomination coin counting circuit and subtracted from the count of an inserted coin counting circuit for the intermediate denomination coin. Then, the count of the inserted minimum denomination coin cointing circuit is again compared with the set vend price, and if the count of the minimum denomination coin counting circuit has not yet reached the set vend price, the amount of one intermediate denomination coin is again transferred to the count of the minimum coin counting circuit from the intermediate coin counting circuit. In this case, if the count of the intermediate coin counting circuit becomes zero with a result that transfer of the amount to the minimum denomination coin counting circuit becomes no longer possible, the amount of one coin of a denomination which is one rank higher than the intermediate denomination (hereinafter referred to as a maximum denomination), e.g. 100 yen is added to the count of the inserted intermediate denomination coin counting circuit and subtracted from the count of the inserted maximum denomination coin counting circuit. Thus, after the amount of one maximum denomination coin has been transferred from the inserted maximum denomination coin counting circuit to the inserted intermediate denomination coin counting circuit, the amount of one intermediate denomination coin is again transferred from the inserted intermediate denomination coin counting circuit to the inserted minimum denomination coin counting circuit in the same manner as heretofore described.

In the foregoing manner, a predetermined amount of coins (i.e., the amount of coins of a denomination which is one rank higher) is transferred from an inserted coin counting circuit for a coin of a high denomination to an inserted coin counting circuit for a coin of a low denomination until the count of the inserted minimum denomination coin counting circuit exceeds the set vend price, thereby to cause the inserted minimum denomination coin counting circuit to count up. Alternatively stated, the transferred amount (part or all of the inserted coins of higher denominations) is converted to the minimum denomination coins.

When the amount of the minimum denomination coins has reached or exceeded the set vend price, the amount of the set vend price is subtracted from the count of the inserted minimum denomination coin counting circuit. After this subtraction, if there is any amount remaining in the inserted minimum denomination coin counting circuit, this amount corresponds to an amount of change to be paid out in the coins of minimum denomination (10 yen); and if there is any amount remaining in the inserted intermediate and maximum denomination coin counting circuits, this amount corresponds to an amount of change to be paid out in the coins of intermediate and maximum denominations (50 and 100 yen). More specifically, the coins of intermediate and maximum denominations which have respectively not been converted to those of minimum and intermediate denominations are retained for change in the respective inserted coin counting circuits, and the difference between the count of the inserted minimum denomination coin counting circuit and the set vend price corresponds to the amount to be paid out as change.

In other words, the control system of this invention provides a "collected money" control for sequentially converting an inserted higher denomination coin to a lower denomination coin so as to collect the amount of money corresponding to the set vend price in the form of minimum denomination coins. Such "collected money" control of this invention is made successively in each vending operation of an article corresponding to one set vend price.

Further, in successive vending operations of plural articles, the amount corresponding to change retained in the respective inserted coin counting circuits (remainder of the amount of the inserted coins) is sequentially reduced, and when a clear signal is finally delivered at the will of the purchaser (upon depression of a clear button), the amount remaining in the respective inserted coin counting circuits is paid out from the vending machine as actual change.

It is to be noted that the number of denominations of the inserted coins are not limited to only three, i.e., minimum, intermediate and maximum but may suitably be increased or decreased in accordance with the currency system in each country.

In the aspects of receipt and collection of the inserted coins, the inserted coins of intermediate and minimum denominations, for example, are collected in coin storage tubes for the respective denominations (main tubes), and the inserted coins of maximum denomination are tentatively retained in an escrow device.

In the process of the aforementioned collected money control, the inserted coins of maximum denomination temporarily retained in the escrow device are delivered one by one to the cash box via a coin accepting path each time one maximum denomination coin is converted to the intermediate denomination coins. When the clear button has finally been depressed by the purchaser, all the coins retained in the escrow device are returned as change.

It is to be noted that instead of the above operation the inserted coins of maximum denomination not converted to the intermediate denomination coins (the amount remaining in the counting circuit) may be paid out as the change from the escrow device via the coin return path and thereafter maximum denomination coins remaining in the escrow device may be collected in the collecting device via the coin accepting path.

The inserted minimum and intermediate denomination coins are collected in the main tubes as the automatically supplied coins. Since, however, the inserted coins of intermediate denomination not converted to the minimum denomination coins are paid out as the change from the main tube storing the intermediate denomination coins, the inserted coins of intermediate denomination in the amount converted to the minimum denomination coins only are collected in the vending machine.

Thus, since the inserted coins of higher denominations (i.e. the intermediate denomination coin as compared with the minimum denomination coin and the maximum denomination coin as compared with the intermediate denomination coin) has a higher possibility of being retained in the inserted coin counting circuit as change i.e., coins to be paid out, the inserted coins of lower denominations (the intermediate denomination coin as compared with the maximum denomination coin and the minimum denomination coin as compared with the intermediate denomination coin) has a higher possibility of being collected in the machine as the amount corresponding to the set vend price. Accordingly, one object of this invention, i.e., to collect lower denomination coins to a maximum possible degree as coins to be stored for change in collecting the amount required for vending an article, so as to enhance the rate of the automatic supplying of the coins stored for change is achieved.

According to this invention, since the number of the inserted coins are counted in the inserted coin counting circuits with respect to each denomination, if the clear button is depressed without a vending operation, the coins are returned in accordance with a combination of denominations based on the counts of the respective inserted coin counting circuits whereby an undesirable utilization of the vending machine as a mere money exchanger can be prevented. In such a case, the device should preferably be so constructed that no coin is paid out from the auxiliary tube even if coins of the same denominations as the inserted ones are paid out but that the inserted coins are merely returned from the main tube which is automatically supplied with the inserted coins. Thus, in case the inserted coins are all returned without any vending operation, the contents of the main and auxiliary tubes remain in the same state as before the coins were inserted in the machine.

According to this invention, each of the main tubes for the respective denominations has a "stored coin counting circuit" conducting addition or subtraction in response to the insertion or return of the stored coins in the main tube. The control system of the machine controls paving out of a change coin or coins depending upon the count of the stored coin counting circuit. In case a coin or coins are paid out for change from the machine, the machine operates to pay out change according to a combination of coins of denominations corresonding to the counts of the inserted coin counting circuits of the respective denominations. In case the amount corresponding to change payout coins is retained in the inserted intermediate denomination coin counting circuit, the system operates to pay out an intermediate denomination coin or coin from the intermediate denomination coin (50 yen coin) main tube if the number of coins stored in an intermediate denomination stored coin counting circuit is one or more.

If the stored number of the intermediate denomination coins in the intermediate denomination stored coin counting circuit becomes zero, the system operates to pay out an intermediate denomination coin or coins from an intermediate denomination coin auxiliary tube. In case a change coin or coins are paid out from the auxiliary tube, if the stored coins in the auxiliary tube become zero, the fact is stored in an intermediate denomination coin storage coin empty memory. The fact that the auxiliary tube has become empty, i.e., "shortage of coin" in the auxiliary tube, is detected from the conditions:

(A) although a coin payout motor has been rotated once, (B) a payout coin detection switch provided in the vicinity of a coin payout port has not been actuated (i.e. no coin has been paid out).

The tube from which the change is to be paid out is transferred to a minimum denomination coin (10 yen coin) main tube by an empty signal which may be produced during the paying out operation from the intermediate denomination coin auxiliary tube, and the amount to be paid out by the intermediate denomination coin or coins is transferred to the minimum denomination coins.

In the next vending operation in the machine, since the memory storage of emptiness of the intermediate denomination coin auxiliary tube has been made, the system operates to pay out an intermediate denomination coin or coins from an intermediate denomination coin main tube even if the content of the intermediate denomination stored coin counting circuit is zero.

It will be appreciated that the tube from which the change is to be paid out may be changed over to the intermediate denomination coin main tube immediately when the intermediate denomination coin auxiliary tube has become empty. It is to be noted that even if the count of the stored coin counting circuit is zero, there may sometimes occur an existence of coins stored therein, as will be described later.

If the system operates to detect the fact (A) there is no intermediate denomination coin in the intermediate denomination coin main tube, or (B) a payout mechanism has become defective so that no intermediate denomination coin is paid notwithstanding that there are coins in the intermediate denomination coin main tube under the same conditions as described above, that is, (A) although a coin payout motor has been rotated once, (B) a payout coin detection switch provided in the vicinity of a coin payout port has not been actuated, in paying out of change coins from the main tube in the state that the emptiness of the intermediate denomination coin auxiliary tube is stored the tube from which the change is to be paid out is switched over to a minimum denomination coin (10 yen coin) main tube. If at this time any number of coins is still stored in the inserted intermediate denomination coin counting circuit (though this counting circuit conducts subtraction each time an intermediate denomination coin is paid out), the remaining amount of the intermediate denomination coins to be paid out is switched over to the minimum denomination coins for subsequent paying out.

The control for switching the tube from which the change is to be paid between the minimum denomination coin main tube and the minimum denomination coin auxiliary tube is effected in the same manner as described above with respect to the intermediate denomination coin tubes. The mode of control in summary is as follows:

(1) When the count of the minimum denomination coin stored coin counting circuit is not zero, coins are paid out from the minimum denomination coin main tube.

(2) When the count of the minimum denomination stored coin counting circuit is zero, coins are paid out from the minimum denomination coin auxiliary tube.

(3) When an empty auxiliary tube is detected (satisfying the above described empty conditions) during a paying out operation of the coin from the auxiliary tube, the fact of emptiness is stored in an empty minimum denomination coin auxiliary tube memory to switch the tube to the main tube.

(4) When a next payout of change is conducted after the paying out operation described in the above paragraph (3) is completed, if the count of the stored coin counting circuit is zero, coins are again paid out from the auxiliary tube in the same manner as that described in the above paragraph (3). This is an operation for confirming whether or not change coins are supplied to the auxiliary tube after the previous change coin has been paid out.

If the amount of collected coins in the main tube falls short of a maximum change payout amount (90 yen) for a single change payout while the coins are paid out from the minimum denomination coin main tube in the state listed in the above paragraph (3), emptiness of the main tube is detected, but the change payout operation is conducted to the last. Thereafter, the vending machine is prevented by the empty signal from any vending requiring a change payout. This empty minimum denomination coin main tube is detected by a conventional empty switch known per se (having an actuator of a microswitch provided in the tube or a proximity switch including a coil along the tube).

In case the system has a plurality of auxiliary tubes for the same denomination coins, the change payout operation can be conducted under a switching control of the tubes from which the change is to be paid out substantially in the same manner as described above. More particularly, the control system may have storage coin empty memories corresponding to the respective auxiliary tubes for storing emptiness detected under the above described conditions. Then, the payout of the coins is switched from the main tube to the first auxiliary tube on condition that the content of the stored coin counting circuit becomes zero as to the coin of this denomination.

When the empty first auxiliary tube is detected, the payout operation of the coins is switched from the first auxiliary tube to the main tube and the emptiness is stored. When the count of the storage coin counting circuit becomes zero in the following vending operation of the machine, the payout operation of the coins is transferred from the main tube to the second auxiliary tube on condition that the first auxiliary tube has been detected to be empty and the emptiness is stored in the memory. When the emptiness is stored as to the second auxiliary tube, the payout operation of the coins is switched from the second auxiliary tube to the main tube. Furthermore, the payout operation of the coins is switched from the main tube to the third auxiliary tube on condition that the first and second auxiliary tubes have been detected to be empty and the content of the storage coin counting circuit is zero. Even if the number of auxiliary tubes increases to any degree, the control may be conducted in the same manner as described above. However, it should be noted that this invention is not limited only to the above described manner of control, but control may be made, for example, in such a manner that the payout operation of the coins is switched from the main to the first auxiliary tube on condition that the count of the storage coin counting circuit for a coin of a specific denomination becomes zero, and that the payout operation of the coins is switched from the first to the second auxiliary tubes on condition that the empty first auxiliary tube is detected and the emptiness is stored in the memory. Thus, the auxiliary tube from which the change is to be paid out is sequentially switched to the following stage of auxiliary tubes on condition that the empty previous auxiliary tube of the former stage is detected and the emptiness is stored in the memory in the same manner as previously described.

It should be understood from the foregoing description that since the control system for a vending machine of this invention controls to pay out change from the auxiliary tube or tubes and finally from the main tube until the coin payout motor rotates in an idling operation (a state in which the motor is rotated once but the coin is not paid out), the coins in the main and auxiliary tubes excluding the minimum denomination coin main tube are completely paid out and, accordingly, no waste of stored coins for paying out the change takes place.

According to this invention, the conventional empty switches need not be provided in the respective coin storage tubes, as only one empty switch is needed in the minimum denomination coin main tube, and "shortage of coin" in the other tubes is detected by the idle rotation of the coin payout motor. Therefore, the machine is simple in construction and economical.

According to this invention, since it is not necessary to provide an empty detection switch for the auxiliary tube, the auxiliary tube need not be a cylindrical coin storage tube but may be a hopper permitting a large number of change coins to be stored, thus forestalling a "shortage of change coins".

Further, the conventional detection of the empty tubes by the empty switch may be erroneous upon occurrence of disorder in the stack of the coins in the tube and the inner diameter of the tube must coincide with the diameter of the coin of a specific denomination to be contained. According to this invention the diameter of the tube may be roughly sized for the respective coins because it is irrelevant to detection of the empty tube.

According to this invention, since the detection of the respective empty tubes is conducted by the idling operation of the coin payout motor, it is necessary to execute a proper corrective treatment in case a coin is caught in a payout slide mechanism and the like driven by the payout motor. Therefore, according to this invention, the control system incorporates a timer circuit which operates during the time required for one revolution of the payout motor (one revolution of the motor for paying out one coin) for detecting the coin caught in the payout mechanism on condition that the carrier switch of the motor is still operating when the operation of the timer circuit is finished. More specifically, if the motor is normally rotated out, the carrier switch becomes off; but if the motor is not completely rotated out due to the sticking of the coin, the carrier switch still remains in an ON state. In such a case, in the control system of this invention, the motor is controlled to rotate normally and reversely several times to release the coin thus caught in the payout mechanism. For example, if the motor is rotated back and forth three times such as normal, reverse and normal rotations or reverse, normal and reverse rotations, the coins thus caught in the payout mechanism can be released.

The control system of this invention has only one empty switch disposed at a predetermined position of the main tube for the minimum denomination coin for displaying whether the amount of the change coins stored in the machine is sufficient for the intended purchase or not. Since insertion and payout of the coins to and from the main tubes corresponding to the respective denominations of the coins have been calculated in the storage coin counting circuit, such display can be made by utilizing the count of this counting circuit. The aforesaid empty switch, however, is required because the count of the counting circuit is cleared upon any interruption of the commercial power source to the vending machine. Therefore, this empty switch functions to ensure detection of the stored coins in the event of interruption of the power source. Thus, according to this invention, the machine has plural main and auxiliary tubes, but only one empty switch is required.

Other objects and features of the invention will become apparent from the description made hereinbelow with reference to the accompanying drawings in which:

DESCRIPTION OF THE PREFERRED EMBODIMENTS

Figure 1:
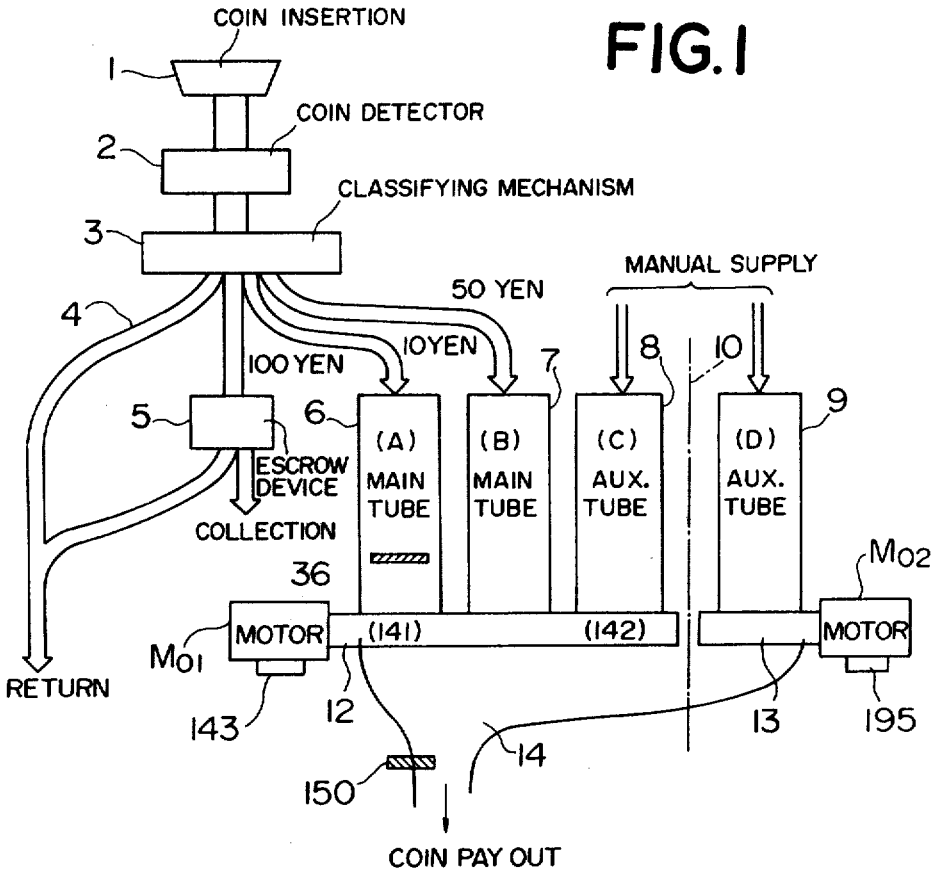
FIG. 1 is a schematic explanatory view of one preferred embodiment of the control system for a vending machine constructed according to this invention as to the mechanical portion of the coin acceptor.

Referring first to FIG. 1, which shows a coin flow path in the coin acceptor mechanism of the vending machine of the invention, a coin inserted from a coin insertion slot 1 is detected to be true or false and its denomination is detected by a coin detector 2, and then a false coin is returned to a return path 4, a 100 yen true coin is classified to an escrow device 5, a 10 yen true coin to a main tube 6, and a 50 yen true coin to a main tube 7 based on the detected results by a classifying mechanism 3. The inserted 10 yen coins are automatically supplied to the 10 yen coin main tube 6, which will hereinafter be called an "A tube" for convenience of description. The inserted 50 yen coins are automatically supplied to the 50 yen coin main tube 7, which will hereinafter be called a "B tube" for convenience of description. An auxiliary tube 8 serves to store 10 yen or 50 yen coins manually supplied thereto and will hereinbelow be called a "C tube" for convenience of description. The tube 8 (C tube) is preferably formed with the diameter of the 10 yen coin. An auxiliary tube 9 serves to store only 10 yen coins supplied manually thereto, and will hereinbelow be called a "D tube" for convenience of description. A, B and C tubes 6, 7 and 8 are preassembled in a standard type coin acceptor, and D tube 9 may be optionally assembled additionally. Auxiliary tube or tubes may be optionally provided in addition to D tube 9 as long as space for attaching the tube is allowed. This auxiliary tube may not only be of cylindrical shape but be of hopper shape as described previously. Further, the auxiliary tube including D tube 9 may be separated from the coin acceptor as partitioned by a one-dotted broken line 10 in FIG. 1, and in case the tube is separated, D tube separation memory flip-flop 20 is set as described later in detail.

At a predetermined position of the 10 yen coin main tube (A tube) 6 (for example, at the position in height of nine coins accumulated) is provided the aforementioned switch 36 for proving the coin detection upon interruption of the commercial power source (A tube empty detection device).

A coin payout mechanism 12 for A, B and C tubes is driven by a first coin payout motor $M_{01}$ for paying out the coins from A tube 6 upon energization of A tube payout solenoid 141 and for paying out the coin from C tube 8 upon energization of C tube payout solenoid 142 in response to the rotation of the motor $M_{01}$ to be described later in detail. When the motor $M_{01}$ is rotated upon deenergization of both the solenoid 141 and 142, coins are paid out from the B tube 7. When a second coin payout motor $M_{02}$ is rotated, coins are paid out from D tube 9 via a payout mechanism 13. A carrier switch 143 is provided at the motor $M_{01}$ and a carrier switch 195 is provided at the motor $M_{02}$ to be described later in detail for proving one revolution of the motors $M_{01}$ and $M_{02}$ required for paying out one coin.

The coins paid out from the respective tubes 6 to 9 are introduced to a coin payout path 14 to operate a payout coin detection switch 150 provided thereat to be described later in detail.

Figure 2:
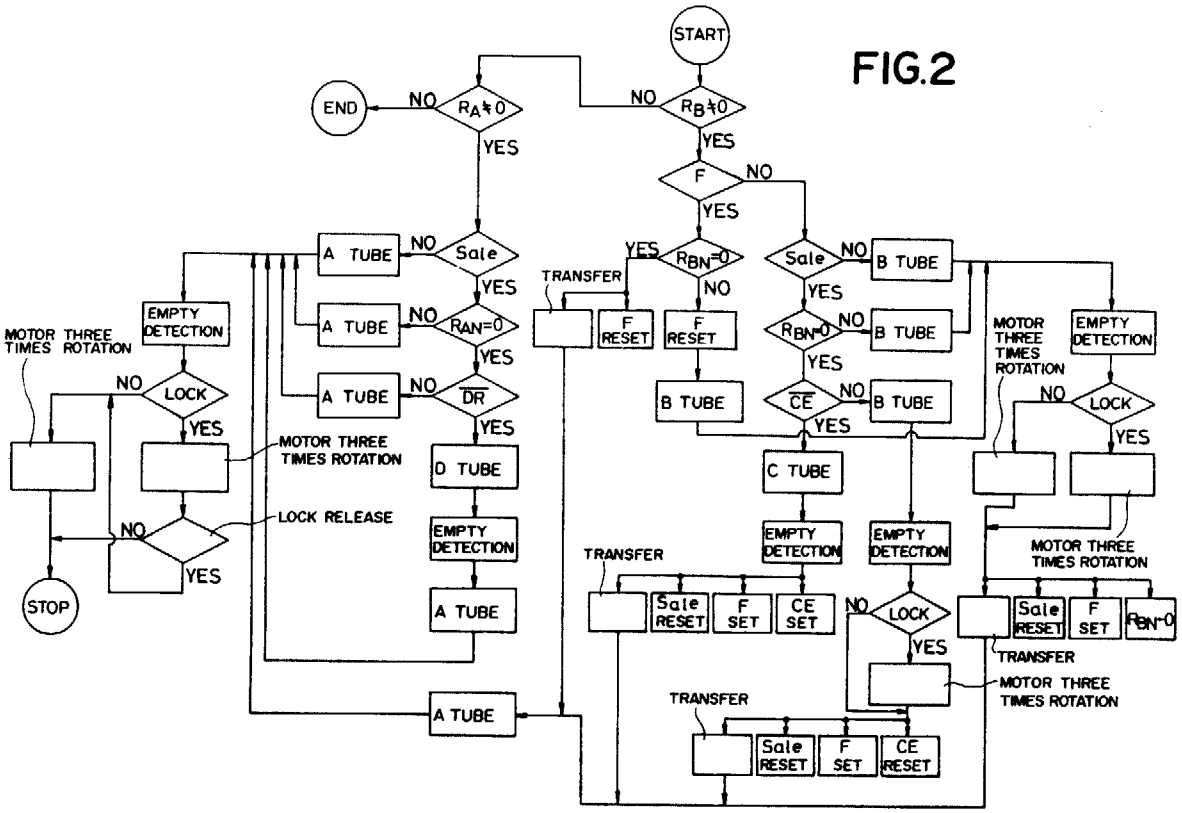
FIG. 2 is a flow chart of the embodiment of the control system for explaining a coin payout tube transferring system.
Figure 3:
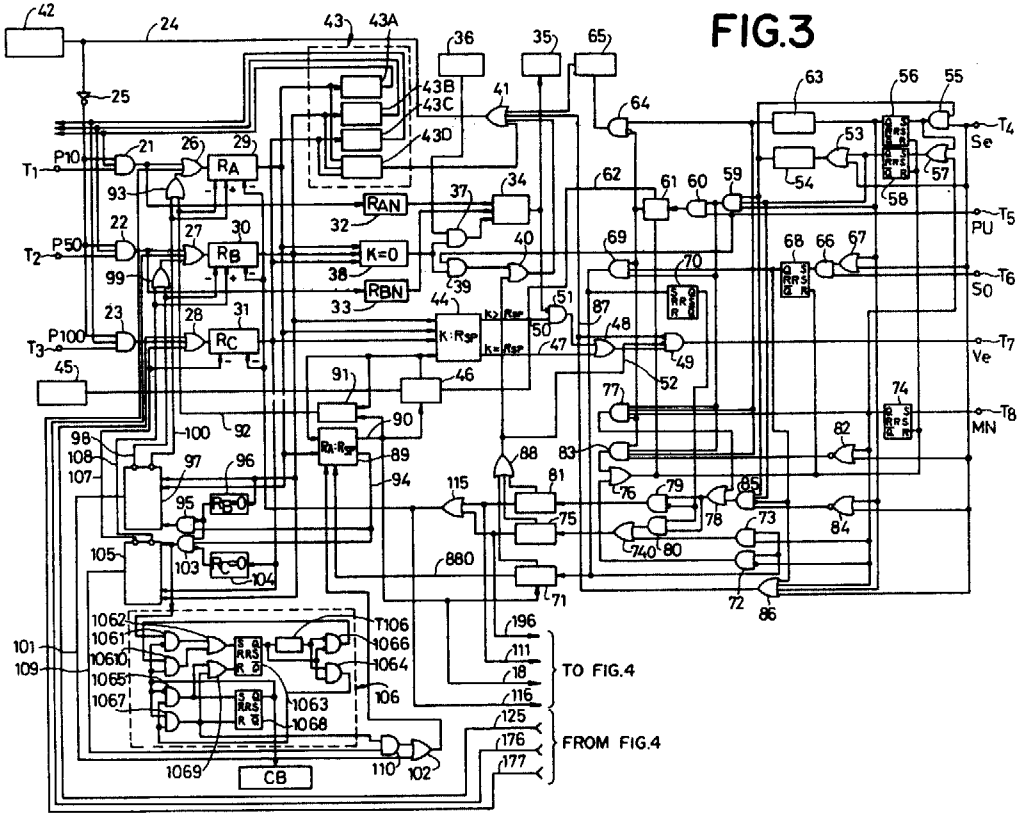
FIG. 3 is a detailed block diagram of half of the control circuit of the embodiment of the control system for the machine constructed according to this invention.
Figure 4:
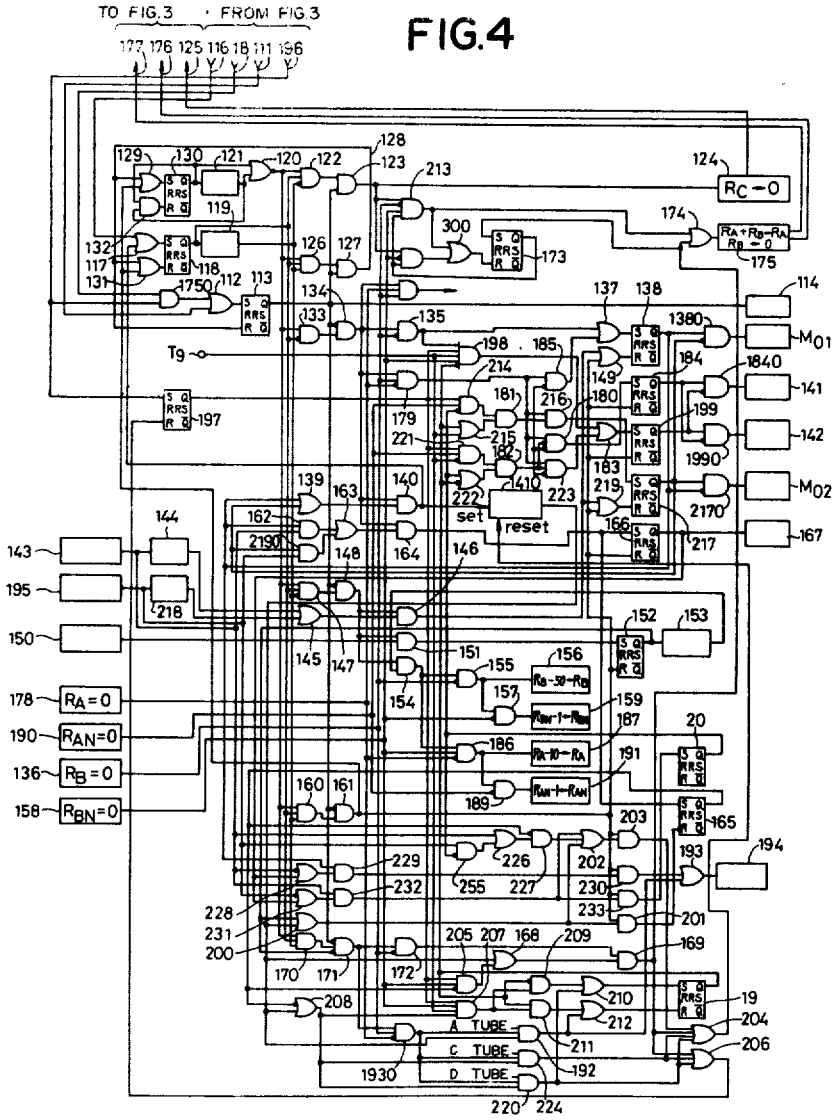
FIG. 4 is a detailed block diagram of the other half of the control circuit of the embodiment of the control system.

In connection with FIGS. 3 and 4, which show a detailed block circuit diagram of a control system for a vending machine constructed according to this invention adapted for the coin acceptor shown in FIG. 1, a flow chart of one example of a payout control system of this invention is shown in FIG. 2 for convenience of easy understanding of the operation of the detailed circuit of the control system shown in FIGS. 3 and 4. The flow chart shown in FIG. 2 corresponds to the description of a payout tube transfer control previously described in detail, and accordingly the description is shortened.

The example of the control system shown in FIG. 2 employs C tube 8 for 50 yen coin auxiliary tube and D tube 9 for 10 yen coin auxiliary tube.

"START" in FIG. 2 shows the depression of a clear button for requiring inserted coin return or change.

"$R_B \neq 0$" represents the condition that the counted content $R_B$ in 50 yen coin counter 30 to be described later in detail corresponding to the inserted intermediate denomination coin counting circuit previously described is not zero.

"YES" indicates the satisfaction of the condition, "NO" means no satisfaction of the condition in the control system.

"$R_A \neq 0$" represents the condition that the counted content Rin 10 yen coin counter 29 to be described later in detail corresponding to the inserted minimum denomination coin counting circuit previously described is not zero.

The line of "$R_B \neq 0$" and YES is a control line for paying out 50 yen coin or coins from the main tube (B tube) 7 or the auxiliary tube (C tube) 8, and "$R_A \neq 0$" and YES line is a control line for paying out 10 yen coin or coins from the main tube (A tube) 6 or auxiliary tube (D tube) 9.

"F" represents the condition whether a flip-flop (173 to be described in detail later) set in case it is necessary to pay out the amount to be paid by the intermediate denomination coin (50 yen coin) by transferring to the minimum denomination coin (10 yen coin) is set or not, and becomes "YES" when the flip-flop is set and becomes "NO" when it is reset.

"F set" represents the setting operation of the flip-flop (173), while "F reset" means the resetting operation of the flip-flop (173).

"Sale" represents the condition that vending operation is executed to the purchaser. When this is "NO", the inserted coins are entirely returned without any vending operation in the machine. When a vend memory flip-flop 70 is set to be described in detail later, "Sale" becomes "YES".

"$R_{BN}=0$" represent the condition that the counted content $R_{BN}$ of 50 yen coin storage counter 33 to be described in detail later corresponding to the intermediate denomination coil storage coin counting circuit previously described in zero.

"$R_{AN}=0$" represents the condition that the counted $R_{AN}$ of 10 yen coin storage counter 32 to be described in detail later corresponding to the minimum denomination coin storage coin counting circuit previously described is zero.

"$\overline{CE}$" indicates the condition that C tube 8 is not empty.

"B tube", "C tube", "A tube" and "D tube" mean the operations for paying out coins from B tube 7, C tube 8, A tube 8, A tube 6 and D tube 9, respectively.

"empty detection" listed after the payout operation blocks of the respective tubes represents detection of the fact that the tube has become empty. This empty detection is achieved by a fact that no coin is paid out notwithstanding that the coin payout motors $M_{01}$ and $M_{02}$ are driven.

"CE set" represents the operation of the empty memory of C tube 8. This operation is to set C tube empty memory flip-flop 19 to be described in detail later.

"CE reset" means the resetting operation of the C tube empty memory flip-flop 19. That is, this operation means that "CE" becomes "YES".

"transfer" represents the condition that the amount to be paid by the intermediate denomination coin (50 yen coin) is paid by transferring it to the minimum denomination coins (10 yen coin) previously described.

"lock" means the condition that the coin to be paid out is caught in the coin payout mechanism 12 so that the motor $M_{01}$ is not completely rotated.

"Motor three times rotation" means rotation of the motor in three times, i.e. in normal, reverse and normal rotations under conditions of "lock" and "YES" as previously described.

"lock release" represents the release of "lock" state as a result of "motor three times rotation".

"$\overline{DR}$" represents the condition that D tube (auxiliary tube or hopper shape auxiliary storage tube optionally added) is not separated from the coin acceptor body. "$\overline{DR}$" YES means that D tube separation memory flip-flop 20 is reset (to be described in detail later).

"END" represents the completion of a coin payout operation.

"STOP" represents the stoppage of the operation of the vending machine due to trouble occurring in the machine.

It is to be noted that although there is no line of "motor three times rotation" at "lock" with respect to the C and D tubes in the flow chart shown in FIG. 2, they may be provided as required.

It will be appreciated that a flow chart of the case wherein C and D tubes 8 and 9 are employed as for the 10 yen coin auxiliary tubes is not particularly disclosed herein, but it may be easily formed based on the previous description and FIG. 2 by those skilled in the art.

Preferred embodiment of the control system of the vending machine according to the invention will be described in detail with reference to the circuit diagram shown in FIGS. 3 and 4 divided for convenience of arrangement of drawing. The circuit shown in FIG. 3 is connected to that shown in FIG. 4 via lines 18, 111, 116, 125, 176, 177 and 196. Although there are additional wiring connections between the circuits in FIGS. 3 and 4 in an actual case, they are omitted. The control circuit shown in FIG. 3 mainly relates to a coin collection control system of the vending machine of this invention, and a major portion of the control circuit shown in FIG. 4 relates to a payout tube switching control system. However, these control circuits are merely divided for convenience of disclosure, and they are not clearly distinguished from each other in respect of their functions.

When a 10 yen true coin is detected by the aforementioned coin detector 2, one 10 yen coin detection pulse $P_{10}$ is applied to the terminal $T_1$. When a 50 yen true coin is detected by the aforesaid coin detector 2, one 50 yen coin detection pulse $P_{50}$ is applied to the terminal $T_2$. When a 100 yen true coin is detected similarly, one 100 yen coin detection pulse $P_{100}$ is applied to the terminal $T_3$.

The pulse signals corresponding to the numbers of 10 yen, 50 yen and 100 yen true coins to be applied to the terminals $T_1$, $T_2$ and $T_3$, respectively are delivered to AND gates 21, 22 and 23, respectively.

To another input of the AND gates 21, 22 and 23 is applied a coin insertion prohibit signal on a line 24 via an inverter 25 to be described in detail later. Further, to still another input of the AND gate 21 is applied an output signal from a 10 yen coin receipt limiting circuit 43A, to another input of the AND gate 22 is applied an output signal from a 50 yen coin receipt limiting circuit 43B, and to another input of the AND gate 23 is applied an output signal from a 100 yen coin receipt limiting circuit 43C. Assuming that the signal on the line 24 is "0" and the output from the respective limiting circuits 43A, 43B and 43C are "1", the AND gates 21, 22 and 23 will pass the pulse signals applied to the terminals $T_1$, $T_2$ and $T_3$, respectively. Thus, the pulse signals are applied to 10 yen, 50 yen and 100 yen coin counters 29, 30 and 31, via OR gates 26, 27 and 28, respectively.

The 10 yen, 50 yen and 100 yen coin counters 29, 30 and 31 serve to count the 10 yen, 50 yen and 100 yen coin detection pulses $P_{10}$, $P_{50}$ and $P_{100}$ from the terminals $T_1$, $T_2$ and $T_3$, respectively, for counting the numbers of the inserted 10 yen, 50 yen and 100 yen coins or a total amount thereof for each of denominations of the 10 yen, 50 yen and 100 yen coins.

If, for example, three 10 yen coins, one 50 yen coin and two 100 yen coins are inserted in the machine, the 10 yen coin counter 29 counts 30, the 50 yen coin counter 30 counts 50, and the 100 yen coin counter 31 counts 200.

The 10 yen coin detection pulses $P_{10}$ from the terminal $T_1$ via the AND gate 21 and the 50 yen coin detection pulses $P_{50}$ from the terminal $T_2$ via the AND gate 22 are respectively applied to 10 yen and 50 yen coin storage counters 32 and 33.

While the 10 yen, 50 yen and 100 yen coin counters 29, 30 and 31 count amount of the inserted coins and are reset to "0" everytime when the vending operation is completed, the 10 yen and 50 yen coin storage counters 32 and 33 serve to continuously add the numbers of inserted 10 yen and 50 yen coins and to continuously subtract the numbers of the paid out coins so as to make addition of difference between the number of the inserted coins and the number of the paid out coins on the basis of the number of 10 yen and 50 yen coins stored at the start of use of the vending machine.

The 10 yen and 50 yen coin storage counters 32 and 33 serve to detect a state wherein the numbers of 10 yen and 50 yen change coins in the machine have become insufficient for change payout, which state will be hereinbelow called "empty".

More specifically, the counted values of the counters 32 and 33 are applied to an empty detection circuit 34. The empty detection circuit 34 functions to produce an output signal "1" when the numbers of the 10 yen and 50 yen coins become, for example, less than four and one respectively, or less than nine 10 yen coins with no 50 yen coin on the basis of the counted values from the counters 32 and 33, which signal "1" is applied to an empty treatment device 35.

When the signal "1" is applied to the empty treatment device 35 the empty treatment device 35 displays shortage of change. In this state the vending operation in the machine is conducted only when amount of inserted coins coincides with a set vend price.

Thus, the empty change coin state is detected on the basis of the counts of the 10 yen and 50 yen coin storage amount counters 32 and 33. If the power source of the vending machine is shut off due to a stoppage of electricity, the counters 32 and 33 are cleared to "0". Accordingly, when the electricity is again supplied to the vending machine, the empty change coin state cannot be accurately detected.

In order to eliminate such difficulty, there is provided an empty detection device 36 for directly detecting the number of residual coins in the 10 yen coin tube in addition to the aforementioned counters 32 and 33.

The empty detection device 36 may, for example, have a coil arranged at a predetermined position of the main tube for empty coin detection based on the variations of the inductance of the coil, or a limit switch arranged at a predetermined position of the main tube for empty coin detection based on the ON or OFF state of the limit switch and producing a signal "1" when the number of coins in the main tube becomes less than the minimum number required for the payout of the change, which signal "1" is applied to one input of an AND gate 37.

To the other input of the AND gate 37 is applied a signal from a comparator circuit 38 for producing a signal "1" only when all the counted values of the counters 29, 30 and 31 are "0".

Accordingly, the AND gate 37 produces a signal "1" only when all the counters 29, 30 and 31 produce signal "0" and this signal "1" is applied to the empty treatment device 35 via the empty detection circuit 34 for empty in the vending machine similar to the previous case.

It will be noted that the aforementioned circuit arrangement is such that the signal from the empty detection device 36 is applied to the empty detection circuit 34 via the AND gate 37 only when all the counted values of the counters 29, 30 and 31 are "0", i.e., when the vending machine is in a ready for operation mode but the signal is not applied thereto slide while the machine is in vending operation. This arrangement is employed for eliminating an inconvenience which might occur if the empty detection device 36 was operated during the vending operation of the machine such, for example, as paying out of change, for, in such a case, no change would be paid out due to the operation of the device 36.

The vending machine of this invention is constructed to prohibit the insertion of the coin in the state that an article selection button (not shown) in depressed, when all the counted values of the counters 29, 30 and 31 are "0".

When the article selection button is depressed, an article selection signal PU is applied to one input of an AND gate 39 via the terminal $T_5$.

To the other input of the AND gate 39 is applied a signal from the comparator circuit 38 becoming "1" only when all the counted value of the counters 29, 30 and 31 are "0".

Accordingly, when the counted values of the counters 29, 30 and 31 are all "0", if the article selection button is depressed, the output of the AND gate 39 becomes "1", which is applied to a coin insertion prohibit device 42 via OR gates 40 and 41 and the line 24.

The coin insertion prohibit device 42 serves to prohibit the insertion of coins in the machine upon receipt of a signal "1", for example by way of a pin projected to the coin insertion slot to prohibit the insertion of the coin, or by way of the structure that even if the coin is inserted in the machine, the inserted coin is not detected by the coin detector but is directly returned to the return outlet.

Thus, in case all the counted values of the counters 29, 30 and 31 are "0", the coin cannot be inserted in the machine even if the article selection button is depressed.

It is apprehended that if a large number of coins of the same denomination are inserted in a single vending or the entire amount of money inserted in the machine is higher than the amount of an article to be vended, there may arise imbalance in the number of the coins retained in the machine resulting in shortage of change and exchange of money between high and low denominations.

Therefore, there is limitation in the maximum amount of inserting coins of the respective denomination (10 yen, 50 yen and 100 yen) per one vending and maximum amount of all inserted coins.

More specifically, the outputs of the counters 29, 30 and 31 counting amount of the inserted coins of the respective denomination are applied to 10 yen, 50 yen and 100 yen coin receipt limiting circuits 43A, 43B and 43C, respectively of a highest limit detecting section 43. The respective limiting circuits 43A, 43B and 43C produce a signal "0" when the contents of the counters 29, 30 and 31 reach limited values such as, for example, 320 yen for 10 yen coins, 800 yen for 50 yen coins, and 700 yen for 100 yen coins, which signal "0" serves to act the prohibition of the insertion of the coins in the machine depending upon the kind of the coins. Further, each output of the counters 29, 30 and 31 is also applied to a total inserted coin highest amount limiting circuit 43D, and when the total amount of the inserted coins reaches the set highest value (arbitrarily set), the limiting circuit 43D produces a signal "1", which is applied to the coin insertion prohibit device 42 for prohibiting the insertion of all the coins thereafter.

The outputs of the counters 29, 30 and 31 separately counted for the inserted coins of 10 yen, 50 yen and 100 yen are applied to a comparator circuit 44.

In the meanwhile, a vend price of an article is set by a vend price setting circuit 45. The output signal from the circuit 45 is applied to a series register 46 which outputs in series the signal from the circuit 45. This output is applied to one input of a comparator circuit 44.

The vend price setting circuit 45 is adapted to set a (binary) signal corresponding to the vend price, for example, by closing selected switch or switches. The circuit 45 therefore sets plural vend price signals corresponding to respective articles in the vending machine in case of vending articles of plural types and produces an output for the set vend price of the article selected upon depression of an article selection button (not shown). The arrangement will not be described in detail.

The comparator circuit 44 compares a total inserted coin amount K ($=R_A+R_BR_C$) which is the sum of the counted values $R_A$, $R_B$ and $R_C$ of the counters 29, 30 and 31 with the set vend price $R_{SP}$ from the resister 45.

When the amount K is equal to the price $R_{SP}$ as a result of comparison in the comparator 44 ($K=R_{SP}$), a signal "1" is produced from the comparator 44 on a line 47 and is applied to one input of an AND gate 49 via an OR gate 48.

When the amount K is larger than the price $R_{SP}$($K$ $R_{SP}$), a signal "1" is produced from the comparator 44 on a line 50 and is thus applied to one input of an AND gate 51. To the other input of the AND gate 51 is applied an inverted signal of the output from the detector 34. When the output of the detector 34 is zero, i.e., sufficient coins are retained for paying out change, the AND gate 51 is opened to gate out the signal "1" on the line 50 via the OR gate 48 to the one input of the AND gate 49 in the same manner as the signal on the line 47.

To another two inputs of the AND gate 49 are applied inverted signals of signals on lines 52 and 87 (both become signal "1" during vending operation of the machine).

Therefore, when the machine is not operated in vending, the AND gate 49 is opened to apply the signal "1" via a terminal $T_7$ to a vending section (not shown) as a vend signal $V_e$.

The vending section starts to control the dispensing of the vend article upon receipt of the vend signal $V_e$, and simultaneously applies a vend start signal Se to a terminal $T_4$.

The construction of the vending section will not be further described since it does not relate to this invention.

The signal Se ("1") applied to the terminal $T_4$ is delivered via an OR gate 53 to a timer 54.

The timer 54 has a predetermined delay time "to" and is constructed to produce an output signal rising from "0" to "1" when the predetermined delay time "to" has elapsed after receipt of the signal "1". The output of the timer 54 is applied to one input of an AND gate 55.

To another input of the AND gate 55 is applied the signal Se from the terminal $T_4$, and if the signal Se applied to the terminal T is retained over the delay time "to" of the timer 54, logical product condition of the AND gate 55 is satisfied to gate out a signal "1" to set input of a vend start signal holding flip-flop 56 to cause the flip-flop 56 to be set and also to gate out the signal "1" to set input of a delay flip-flop 58 via an OR gate 57 to cause the flip-flop 58 to be set. Set output "1" of flip-flop 58 is applied to the timer 54 via the OR gate 53 to cause the timer 54 to be operated.

Further, the set outputs "1" of the flip-flops 56 and 58 and the output of the timer 54 are applied to the inputs of an AND gate 59.

When the flip-flops 56 and 58 delivered their outputs "1" and the timer 54 has completed its delay time to produce an output "1", i.e., the vend start signal Se is confirmed, the AND gate 59 will receive all "1" signals at the inputs thereof and will thus gate out an output signal "1" to an AND gate 60.

To another input of the AND gate 60 is applied an article selection signal PU (signal "1") representing the depression of the article selection button via a terminal $T_5$. Accordingly, the AND gate 60 receives all "1" signals at their inputs when the vend start signal Se is confirmed and gates out a signal "1" to an article selection memory 61.

The memory 61 also receives the signal representing the vend article from the register 46 at the input thereof to store the selection of the article.

In the meanwhile, if a signal "1" representing the selection of desired article has not been stored in the memory 61 upon lapse of a predetermined time (a time required for dispensing the article) after the flip-flop 56 is set, i.e., after the vend start signal Se is confirmed, occurrence of a fault in the machine is assumed and the operation of the vending machine is stopped at this time.

This operation is conducted in the following manner.

The set output "1" of the flip-flop 56 is applied to a timer 63, which is constructed and operated in the same manner as the timer 54 but has a delay time $t_1$ (a time sufficient for completing the normal dispensing operation of the article) for producing a signal rising from "0" to "1" upon lapse of the time $t_1$ often receipt of the signal "1".

The output "1" of the timer 63 is applied to one input of an AND gate 64.

To another input of the AND gate 64 is applied an inverted signal of the output of the memory 61. Accordingly, when the delay time of the timer 63 has elapsed and the signal "1" is not stored in the memory 61, the condition of the AND gate 64 is satisfied. Therefore, the output "1" of the AND gate 64, is applied to a stoppage circuit 65 to stop the operation of the machine and to cause the circuit 65 to produce a signal "1" which is applied to the device 42 via the OR gate 41 to prohibit the coin to be inserted in the machine.

Thus, if the flip-flop 56 is set and the signal "1" representing the selection of the article is not stored in the memory 61 until the delay time of the timer 63 is completed, the operation of the machine is stopped, but if the machine is normally operated, the signal "1" representing the selection of the article is stored in the memory 61 before the delay time of the timer 63 has elapsed. Then, an article dispensing signal So (signal "1") representing the completion of dispensing of the article is applied from a terminal $T_6$ to one input of an AND gate 66.

To another input of the AND gate 66 is applied the signal Se from the terminal $T_4$ and the output signal from the flip-flop 56 via an OR gate 67.

Accordingly, if the signal So is applied to the AND gate 66 when the signal Se is applied via the terminal $T_4$ to the AND gate 66 or the set output "1" from the flip-flop 56 is applied to the AND gate 66, the signals "1" are applied to all the input of the AND gate 66 to cause the gate 66 to gate out a signal "1" which is applied to a set input of an article dispensing signal holding flip-flop 68 to set the flip-flop 68.

An AND gate 69 receives the set output "1" of the flip-flop 68, the output "1" of the AND gate 59 and the output "1" of the memory 61.

When the set output of the flip-flop 68 is applied to the AND gate 69, the output of the AND gate 59 applied to the AND gate 69 becomes "1", and the signal "1" is stored in the memory 61, i.e., the suitable vending operation is started upon insertion of true coin, the selection of the article is exactly conducted, and the dispensing operation of the article is completed, the signals "1" are applied to all the inputs of the AND gate 69 to cause the AND gate 69 to gate out a signal "1".

The output signal "1" from the AND gate 69 is applied to a set input of a vend memory flip-flop 70 to set the flip-flop 70.

The output signal "1" from the AND gate 69 is also applied to a collection command circuit 71 for starting the collection of inserted coins to be described in detail later and also to one respective input of AND gates 72 and 73.

To another input of the AND gate 73 is applied a set output signal from an exact calculation signal holding flip-flop 74 which is set upon receipt of an exact calculation signal MN from a terminal $T_8$ upon depression of the exact calculation button (not shown), and to another input of the AND gate 72 is applied an inverted signal of set output signal from the flip-flop 74.

Accordingly, if the set output of the flip-flop 74 has been applied to the AND gate 73 by depression of the exact calculation button when the output of the AND gate 69 is signal "1" the signals "1" are applied to all the input of the AND gate 73 to cause the AND gate 73 to gate out a signal "1" which is applied via an OR gate 740 to a change payout command circuit 75 to command a change payout operation to be described in detail later.

If the flip-flop 74 has not been set by no depression of the button (not shown) when the output of the AND gate 69 becomes "1" the signals "1" are applied to all the input of the AND gate 72 which gates out a signal "1" which is applied via an OR gate 76 to still another input of the memory 61 and reset inputs of the flip-flops 68, 56 and 58 to reset these flip-flops 68, 56 and 58 for preparing the following vending operation of the machine in continuous vending operations.

When an article sending out signal So is not applied to terminal $T_6$ so that the article sending out signal flip-flop 68 is not set before the delay operation of the timer 63 terminates in spite of the setting of the vend start signal holding flip-flop 56 and the delay flip-flop 58, this state signifies that no article was sent out. Accordingly, if the clear button has been depressed, the coins are returned or the change coins are paid out, whereas if the clear button has not been depressed, the article selection memory 63 and flip-flops 56, 58, 70 and 74 should be reset to prepare for the next vending operation in a manner to be described hereunder. At first, it is assumed that the clear button has been depressed and the clear signal holding flip-flop 74 has been set.

The outputs of the clear flip-flop 74, the timer 63, the AND gate circuit 59 and the article selction memory 61 are applied to the inputs of an AND gate circuit 77.

The AND gate circuit 77 is enabled when vending start signal holding flip-flop 56 and the delay flip-flop 58 are set whereby AND gate circuit 59 is enabled, and when "1" is stored in the article selection memory 61 and the delay action of the timer 63 has completed, signal "1" is applied to each one input of AND gate circuit 79 and 80 via a OR gate circuit 78.

To the other input of the AND gate circuit 80 is applied the output of the vend memory flip-flop 70 and to the other input of the AND gate circuit 79 is applied the inverted output of the vend memory flip-flop 70.

The vend memory flip-flop 70 is constructed such that it is set at each vending operation and that is in reset when the clear button is depressed and the clear operation (to pay out change and to return coins) has been completed so that when not a single vending operation is made, the vend memory flip-flop 70 has not been set thereby enabling the AND gate circuit 79. Accordingly, signal "1" is applied to a coin return commanding circuit 81 thereby commencing the operation of returning amount of the inserted coins as will be described later.

When at least one vending operation has been made so that the vend memory flip-flop 70 has been set, the AND gate circuit 80 is enabled.

Consequently, signal "1" is applied to a change payout commanding circut 75 to commence payout of the change.

Assume now that the clear button has not been depressed so that the clear signal holding flip-flop has not been set. Under these conditions the output from the exact calculation signal holding flip-flop 74 and a signal from terminal $T_4$ are applied to the inputs of a NOR gate circuit 82. This NOR gate 82 circuit applies a signal "1" to one input of a AND gate circuit 83 when the clear signal holding flip-flop 74 is not set and the signal from terminal $T_4$ is "0" (that is the vend start signal has not been applied). The other inputs of the AND gate circuit 83 are connected to receive the outputs of the timer 63, the AND gate circuit 59 and the article selecting memory 61.

Consequently, when the AND gate circuit 69 is not enabled because an article send out signal is not applied thereto until the termination of the delay time of the timer although the vend start signal has been confirmed and signal "1" has been stored in the article selection memory 61, so that when memory 61, flip-flop 56, 58 and 74 are not reset the AND gate circuit 83 is enabled whereby a signal "1" is applied to the reset terminal of memory 61 and flip-flops 56, 58, 74 and 70 via OR gate circuit 76 thereby resetting these elements to prepare for the next vending operation.

When the vend condition is not satisfied and when the vend start signal Se is not applied from terminal $T_4$, upon depression of the clear button, the change will be paid if one vend has been made and coins will be returned if no vend has been made.

The signal from terminal $T_4$ and the output from the vend start signal holding flip-flop 56 are applied to the inputs of a NOR gate circuit 84 which produces a signal "1" when the signal from terminal $T_4$ is "0" and the vend start signal holding flip-flop 56 has not been set. The signal "1" is applied to one input of a AND gate circuit 85. The other inputs of this AND gate circuit 85 are connected to receive the outputs of the delay flip-flop 58 and the timer 54, and the inverted output from the article sending out signal holding flip-flop 68.

When the clear push button is depressed and when the clear signal holding flip-flop 74 is set, the set output thereof is applied to the delay flip-flop 58 via OR gate circuit 57 thus setting the same. The set output from the delay flip-flop 58 is applied to the timer 54 via OR gate circuit 53, thereby starting the timer.

For this reason, when the clear push button has been depressed and the timer 54 has completed its operation but when the article sending out flip-flop 68 has not been set, the AND gate circuit 85 is enabled to apply a signal "1" to one input of the AND gate circuits 79 and 80 via OR gate circuit 78. As above described, to the other inputs of the AND gate circuit 80 and 79 are respectively applied the output and the inverted output of the vend memory flip-flop 70 so that when this flip-flop 70 has not been set, the AND gate circuit 79 is enabled so as to apply a signal "1" to the coin return commanding circuit 81. However, when the vend memory flip-flop 70 has been set, the AND gate circuit 80 is enabled thus applying a signal "1" to the change payout commanding circuit 75 via OR gate circuit 74.

When the coins are inserted during the vending operation of the automatic vending machine, there is a disadvantage that the counts of the counter 29, 30 and 31 vary. For this reason, the vending start signal Se applied to terminal $T_4$, the output from the vend start signal holding flip-flop 56, the output from the clear signal holding flip-flop 74 and the output from the article send out signal holding flip-flop 68 are applied to the coin insertion prohibit circuit 42 through OR gate circuit 86, line 87 and OR gate circuit 41 so as to prohibit the insertion of the coin so long as at least one of said signals is "1" by actuating the coin insertion prohibit circuit 42.

The coin collection commanding circuit 71, the change payout commanding circuit 75, and the coin return commanding circuit 81 are constructed to respectively hold signal "1" during the coin collecting operation, the change payout operation and the coin returning operation respectively, so that the outputs of these circuits 71, 75 and 81 are applied to the coin insertion prohibit circuit 42 through OR gate circuit 88, 40 and 41 respectively, so as to actuate the coin insertion prohibit circuit 42 during the change payout operation or the coin returning operation or the coin collecting operation for prohibiting the insertion of the coin.

The coin collecting operation, coin returning operation and the change payout operation will now be described in detail.

Coin Collecting Operation

The coin collecting operation is executed by subtracting the vend set price $P_{SP}$ from the count $R_A$ of the 10 yen coin counter 29. Where it is impossible to subtract the vend set price $R_{SP}$ from the count $R_A$ of the 10 yen coin counter 29 a transfer is made from the 50 yen coin counter 30 or the 100 yen coin counter 31 to the 10 yen coin counter 29.

When the coin collection commanding circuit 71 stores signal "1" this signal is applied to comparator 89 via line 880. Signals representing the vend set price $R_{SP}$ from the series register 46 and the count $R_A$ of the 10 yen coin counter 29 are applied to the comparator 89 so that the set price $R_{SP}$ and the count $R_A$ of the 10 yen coin counter 29 are compared with each other.

Where the count $R_A$ of the 10 yen coin counter 29 is equal to or larger than the set price $R_{SP}$($R_A \geqq R_{SP}$) it is possible to subtract $R_{SP}$ from $R_A$. This subtraction is performed in the following manner.

Then, when the condition $R_A \geqq R_{SP}$ is satisfied, the comparator 89 applies a signal "1" to line 90. This signal is applied to one input of the gate circuit 91 as a gate signal. The other input of the gate circuit 91 is connected to receive a pulse signal representing the vend set price $R_{SP}$ from the series register 46.

Accordingly, when signal "1" is applied to line 90, the gate circuit 91 is enabled to apply the pulse signal representing the vend set price $R_{SP}$ to the subtract commanding terminal of the 10 yen coin counter 29 via line 92 thus setting the same for the subtraction mode. At the same time, this pulse signal is applied to the count input terminal of the 10 yen coin counter 29 through OR gate circuits 93 and 26.

In this manner, the vend set price $R_{SP}$ is subtracted from the counter $R_A$ of the 10 yen coin counter 29.

However, during the operation of the comparator 90, if the count $R_A$ of the 10 yen coin counter 29 is smaller than the vend set price $R_{ST}$ ($R_A < R_{SP}$) it would be impossible to subtract $R_{SP}$ from $R_A$. Under these circumstances a portion of the count $R_B$ of the 50 yen coin counter 30 or the count $R_C$ of the 100 yen coin counter 31 is transferred to the content $R_A$ of the 10 yen coin counter 29 so as to establish a relation $R_A \geqq R_{SP}$. Thereafter $R_{SP}$ is subtracted from $R_A$. This transfer operation is performed as follows.

During the operation of the comparator 89, if $R_A < R_{SP}$, a signal "1" will be applied to line 94, which is applied to one input of an AND gate circuit 95. The other input of the AND gate circuit 95 is supplied with the inverted output from comparator 96 which produces a "1" output when the count $R_B$ of the 50 yen coin counter 30 is zero ($R_B = 0$). Accordingly, the AND gate circuit 95 is enabled when the count $R_B$ of the 50 yen coin counter 30 is not equal to zero, thus applying signal "1" to 50 yen→10 yen transfer commanding circuit 97. This circuit 97 operates to command a transfer operation for subtracting 50 from the count $R_B$ of the 50 yen coin counter 30 and for adding 50 to the count $R_A$ of the 10 yen counter 29. More particularly, when applied with signal "1" from the AND gate circuit 95 the 50 yen→10 yen transfer commanding circuit 97 produces one pulse on line 98 which is applied to the subtraction command terminal of the 50 yen coin counter 30 and to the count input terminal thereof via OR gate circuits 99 and 27 thus subtracting 50 from the counting $R_B$. At the same time, the 50 yen→10 yen transfer commanding circuit 97 produces five pulses on line 100 which are applied to the addition commanding terminal of the 10 yen coin counter 29 and to the count input terminal of the 10 yen coin counter 29 via OR gate circuits 93 and 26, thus adding 50 to the count $R_A$.

Figure 5:
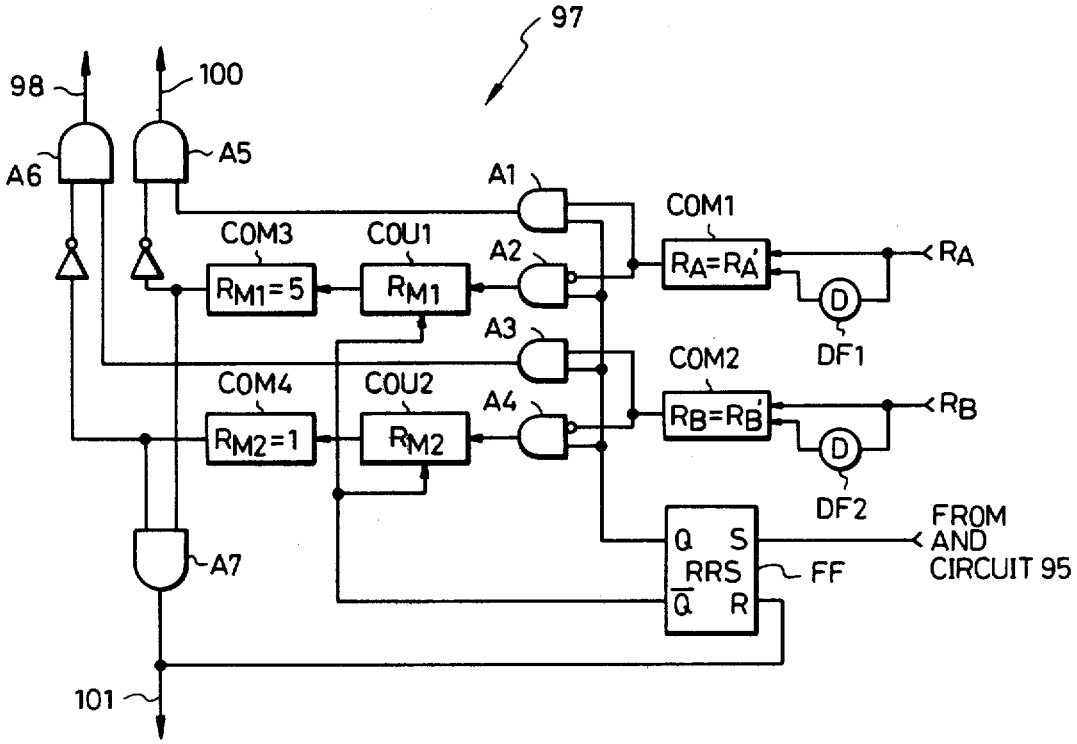
FIG. 5 is a schematic diagram of a transfer commanding circuit depicted as a block in FIG. 3.

A suitable structure for the transfer commanding circuit 97 is schematically shown in FIG. 5. A detailed description of its operation will now be set forth. The flip-flop FF is set by a signal "1" from AND gate $A_{95}$. Comparison circuits $COM_1$ and $COM_2$ respectively compare count value $R_A$ to 10 yen coin counter 29 with value $R_A'$ produced by delaying count value $R_A$ by delay flip-flop $DF_1$ by one timing (i.e. a count value of one timing before) and count value $R_B$ of 50 yen coin counter 30 with value $R_B'$ produced by delaying count value $R_B$ by delay flip-flop $DF_2$ by one timing and produce a signal "1" when $R_A = R_A'$ and $R_B = R_B'$. Accordingly, as AND gates $A_1$ and $A_3$ are enabled, a signal "1" is applied to lines 100 and 98 via AND gates $A_5$ and $A_6$ thereby adding 1 to count value $R_A$ of 10 yen coin counter 29 and deducting 1 from count value $R_B$ of 50 yen coin counter 30. Consequently, the outputs of comparison circuits $COM_1$, $COM_2$ become "0" thereby enabling AND gates $A_2$ and $A_4$. The outputs of AND gates $A_2$ and $A_4$ are applied to counter $COU_1$, $COU_2$.

Comparison circuit $COM_3$ compares count value $R_{M1}$ of counter $COU_1$ with a value 5 and produces a signal "1" when $R_{M1}=5$. Comparison circuit 4 compares count value $R_{M2}$ of counter $COU_2$ with a value 1 and produces a signal "1" when $R_{M2}=1$. Accordingly, the output of comparison circuit $COM_4$ becomes "1" thereby enabling AND gate $A_6$. Comparison circuit $COM_3$ produces a signal "1" when 5 pulses have been delivered from AND gate $A_5$ by alternate enabling of AND gates $A_1$ and $A_2$ and count value of counter $COU_1$ thereby has reached 5. This causes AND gate $A_5$ to be disabled. When the outputs of comparison circuits $COM_3$ and $COM_4$ have both become "1", AND gate $A_7$ is enabled thereby providing a signal "1" on line 101 and also setting flip-flop FF. Counters $COU_1$ and $COU_2$ are reset by reset output from flip-flop FF.

When the transfer from the 50 yen coin counter 30 to the 10 yen coin counter 29 has been completed by the 50 yen→10 yen transfer commanding circuit 97, a signal "1" is applied to the comparator 89 from the transfer commanding circuit via line 101 and a OR gate circuit 102 for comparing again the count $R_A$ of the 10 yen coin counter 29 and the vend set price $R_{SP}$.

In this manner, the transfer from the 50 coin counter 30 to the 10 yen coin counter 29 is continued until the count $R_A$ of the 10 yen coin counter 29 becomes equal to or larger than the vend set price $R_{SP}$ ($R_A \geqq R_{SP}$). However, when the count $R_B$ of the 50 yen coin counter 30 becomes zero, the output from the comparator 96 becomes "1" thus disenabling the AND gate circuit 95 with the result that the 50 yen→10 yen transfer commanding circuit 97 becomes inoperative. Then, the transfer is made from the 100 yen counter 31.

When the count of the 50 yen coin counter 30 is zero the comparator 96 produces a signal "1" which is applied to one input of a AND gate circuit 103. To the other inputs of this AND gate circuits 103 are applied a signal on line 94 which shows that the count $R_A$ of the 10 yen coin counter 29 is smaller than the vend set price $R_{SP}$, and an inverted output of a comparator 104 which produces "1" when the count $R_C$ of the 100 yen coin counter 31 is zero.

Thus, the AND gate circuit 103 is enabled when the signal on line 94 is "1" and $R_B=0, R_C \neq 0$ to apply signal "1" to the 100 yen→50 yen transfer commanding circuit 105. Circuit 105 has the same structure and performs the same function of circuit 97 hereinbefore described in detail in connection with FIG. 5. This signal "1" is also applied to a 100 yen coin receiving solenoid controller 106 thus receiving one 100 yen coin that has been held. The 100 yen coin receiving solenoid controller 106 comprises a flip-flop 1063 having a set input connected to receive the output from the AND gate circuit 103 via a AND gate circuit 1061 and a OR gate circuit 1062, a timer T106 which is operated when the flip-flop 1063 is set, a flip-flop 1068 having a set input connected to receive the output of the timer T106 via AND gate circuits 1064 and 1065 and an OR gate circuit 1069 for resetting the flip-flop 1063, the inputs of the OR gate circuit 1069 being connected to the output of AND gate circuits 1065 and 1067. The set output of the flip-flop 1068 is used to operate a 100 yen coin receiving solenoid coil (escrow cash box solenoid coil) CB for receiving 100 yen coins that have been inserted and held.

The output from the flip-flop 1068 is applied to the other input of AND gate circuit 1067 while the inverted output is applied to the other inputs of the AND gate circuits 1065 and 1061 one input of an AND gate circuit 10610 is connected to the output of an AND gate circuit 1066. The output of the flip-flop 1063 is applied to the other input of a AND gate circuit 1064 and the inverted output is applied to the other input of an AND gate circuit 1066.

Consequently, the signal "1" from the AND gate circuit 103 is applied to the flip-flop 1063 via the AND gate circuit 1061 and the OR gate circuit 1062 because the signal applied to the other input of the AND gate circuit 1061 is "1" and the set output of the flip-flop 1063 operates the timer T106. After the delay time of the timer T106, the AND gate circuit 1064 is enabled to supply its output to flip-flop 1068 through the AND gate circuit 1065 thus setting the flip-flop 1068. Accordingly, the 100 yen coin receiving solenoid coil CB is energized to receive one 100 yen coin. Furthermore, the output from the AND gate circuit 1065 resets the flip-flop 1063 via the OR gate circuit 1068. As this time, the AND gate circuit 1066 is enabled and its "1" output is applied to one input of the AND gate circuit 10610. Since the "1" output from the flip-flop 1068 is applied to the other input of the AND gate circuit 10610, the output thereof sets again the flip-flop 1063 via the OR gate circuit 1062.

In the same manner as above described, the output of the flip-flop 1063 enables the AND gate circuit 1064 after the delay time of the timer T106. As this time, however, since the flip-flop 1068 is set the AND gate circuit 1067 is enabled and its "1" output resets the flip-flop 1068 whereby the 100 yen coin receiving solenoid coil CB is deenergized thus completing one receiving operation. In this manner, the solenoid coil is energized for a time sufficient to receive one 100 yen coin. For the continuous reception, the solenoid coil is energized after a time sufficient to permit the second and following 100 yen coins in the escrow to fall into the 100 yen coin receiving solenoid coil.

The 100 yen→50 yen transfer commanding circuit 105 operates to transfer 100 to the counts $R_B$ of the 50 yen coin counter 30 based on the counts $R_C$ of the 100 yen coin counter 31 and to produce one pulse on line 101 and apply this pulse to the 100 yen coin counter 31 via OR gate circuit 28 thus subtracting 100 from the count $R_C$. At the same time, the 100 yen→50 yen transfer commanding circuit 105 produces two pulses on line 108 which are applied to the 50 yen coin counter 30 via OR gate circuit 99 and 27 for adding 100 to the counts $R_B$ of the counter 30.

When the transfer of 100 yen from the 100 yen coin counter 31 to the 50 yen coin counter 30 under the control of the 100 yen→50 yen transfer commanding circuit 105 is finished the transfer commanding circuit 105 produces a signal "1" on line 109 which is applied to one input of an AND gate circuit 110.

To the other input of the AND gate circuit 110 is applied a signal "1" which is produced when one 100 yen coin is received from the escrow solenoid coil 106 so that when receival of the 100 yen coin is 106 so that when receival of the 100 yen coin is confirmed the AND gate circuit 110 is enabled thus applying signal "1" to the comparator 89 via an OR gate circuit 102 whereby the count $R_A$ of the 10 yen coin counter 29 is compared again with the vend set price $R_{SP}$. At this time, however, since the count $R_B$ of the 50 yen coin counter 30 is not zero the AND gate circuit 95 is enabled thereby transferring from the 50 yen coin counter 30 to the 10 yen coin counter 29 by the action of the 50 yen→10 yen transfer commanding circuit 97.

In this manner, the transfer from the 100 yen coin counter 31 to the 50 yen coin counter 30 and the transfer from the 50 yen coin counter to the 10 yen coin counter 29 are repeated until the count $R_A$ of the 10 yen coin counter 29 becomes equal to or larger than the vend set price $R_{CP}$, that is $R_A \geqq R_{SP}$.

When the relation $R_A \geqq R_{SP}$ is established, the comparator 89 produces a signal "1" on line 90 so that the vend set price $R_{SP}$ is subtracted from the count $R_A$ of the 10 yen coin counter 29 as above described.

The signal "1" on line 90 is also applied to the series register 46 and the coin collection commanding circuit 71 to reset the same, thus finishing the coin collection operation.

Completion of the coin collection operation means one vending operation thus preparing for the next vending operation or the clear operation.

Unless the clear push button is depressed, said vending and coin collection operations are repeatedly performed each time the vend condition is satisfied.

Each time a vending operation completes the output of the OR gate circuit 86 becomes "0" and hence the output of the OR gate circuit 41 also becomes "0" thereby stopping the operation of the coin insertion prohibiting device 42. For this reason, it is possible to insert coins whenever a vending operation completes.

With reference to FIG. 4 the coin returning operation when signal "1" is stored in the coin returning commanding circuit 81 and the change payout operation when signal "1" is stored in the change payout commanding circuit 75 will be described.

Coin Returning Operation

When the purchaser has inserted coins but stopped purchase for one reason or other and consequently depressed the clear push button, signal "1" Is stored in the coin returning commanding circuit 81.

The signal "1" from the coin returning commanding circuit 81 is applied to the escrow flip-flop 113 via line 111 and an OR gate circuit 112 thus resetting flip-flop 113.

When the escrow flip-flop circuit 113 is set, its set output "1" is applied to the escrow solenoid coil 114 whereby the solenoid coil 114 is energized to return all 100 yen coins stored, therein.

The signal "1" from the coin returning commanding circuit 81 is applied to the 10 yen coin counter 29, the 50 yen coin counter 30 and the 100 yen coin counter 31 via an OR gate circuit 115 thus changing these counters to subtracting modes. Furthermore, this signal "1" is applied to a flip-flop 118 via a line 116 and an OR gate circuit 117 to reset the same. The set output of the flip-flop is applied to a timer 119 which has the same construction as the aforementioned timers 54 and 63. Thus, they have a delay time $t_3$ and their outputs build up to "1" level when the delay time $t_3$ has elapsed from the receipt of signal "1".

An AND gate circuit 122 is provided having inputs connected to receive the outputs from the flip-flop 118, the inverted signal of output of the timer 119, and the output of a NOR gate circuit 120 (the output of the NOR gate circuit 120 is "0" only when the timer 121 to be described is operating. At this time, however, since the timer 121 is not operating the output of the NOR gate circuit 120 is "1"). Thus, the AND gate circuit 122 is enabled during the operation of the timer 119 thus applying a signal "1" to one input of an AND gate circuit 123.

Since the other input of the AND gate circuit 123 is applied with the output from the escrow flip-flop 113, the AND gate circuit 123 is enabled so as to apply a signal "1" to a 100 yen coin counter count down commanding circuit 124 which applies pulses of the number equal to the number of 100 yen coins returned by the energization of the escrow solenoid coil 114 to the count input terminal of the 100 yen coin counter 31 via line 125 and the OR gate circuit 28.

At this time, the 100 yen coin counter 31 is cleared by a signal on line 125 (to be described hereunder) so that the count $R_C$ of this counter becomes zero.

The delay time $t_3$ of timer 119 assures an operating time necessary to return the 100 yen coins by the escrow solenoid coil.

When the delay time $t_3$ of the timer 119 elapses the AND gate circuit 126 is enabled which is applied with the outputs of the flip-flop 118, timer 119 and the NOR gate circuit 120 thus applying the signal "1" to one input of an AND gate circuit 127.

Since the reset output "1" of the escrow flip-flop 113 is applied to the other input of the AND gate circuit 127, this ANd gate circuit is enabled to apply a signal "1" to the reset terminal of the flip-flop 118 through line 128 and a OR gate circuit 131 thus resetting the flip-flop 118. At the same time, the signal "1" on line 128 is applied to the reset terminal of the escrow flip-flop 113 thus resetting the same. The set output "1" of the flip-flop 130 is applied to the timer 121 which is identical to the timer 119 and has a delay time $t_2$. When applied with signal "1" the timer 121 operates and after the elapse of the delay time $t_2$, its output changes to "1". Consequently, the output of the NOR gate circuit 120 which is applied with the outputs of the flip-flop 130 and timer 121 is "0" while the timer 121 is operating.

When the delay time $t_2$ of timer 121 has elapsed, the output of the timer 121 becomes "1" so that the AND gate circuit 132 applied with the outputs of the flip-flop 130 and timer 121 is enabled and its output "1" is applied to the reset terminal of the flip-flop 120 thus resetting the same. Then the output of the timer 121 becomes "0" and the NOR gate circuit 120 produces signal "1".

As a consequence, the AND gate circuit 133 applied with the output of the NOR gate circuit 120 and the inverted signal of output of the flip-flop 118 is enabled thereby applying signal "1" to one input of an AND gate circuit 134. The other input thereof is connected to receive the inverted signal of output of the escrow flip-flop 113. At this time, since the escrow flip-flop circuit 113 has been reset the AND gate circuit 134 is enabled to apply signal "1" to one input of an AND gate circuit 135 having the other input applied with the inverted signal of output of a comparator 136 which produces signal "1" when the count $R_B$ of the 50 yen coin counter 30 is zero.

Consequently, when $R_B=0$, the AND gate circuit 135 is enabled to apply signal "1" to the set terminal of a flip-flop 138 via OR gate circuit 137. The output of the flip-flop 138 is applied to one input of an AND gate circuit 140 via an OR gate circuit 139 and the other input of the AND gate circuit 140 is connected to receive the output of the AND gate circuit 134. Accordingly, when the flip-flop 138 is set, the AND gate circuit 140 is enabled to apply a signal "1" to the set terminal of the flip-flop 118 via an OR gate circuit 117 whereby this flip-flop is set to operate the timer 119. The output "1" from the AND gate circuit 140 is also applied to a counter 1410.

The purpose of counter 1410 is to produce a command signal when no coin is paid out owing to the fact that a paid out coin is caught by a coin payout actuator as will be described hereinafter. The output of the flip-flop 138 is applied to a coin payout motor $M_{01}$ via a AND gate circuit 1380 having the other input connected to receive the inverted signal of set output of a flip-flop 217 adapted to operate a motor $M_{02}$ to be described later whereby motor $M_{01}$ is rotated when motor $M_{02}$ is not rotated.

When the coin payout motor $M_{01}$ rotates, the coin payout actuator (not shown) is rotated for paying out coins from the 10 yen coin main tube (A tube) or the 50 yen coin main tube (B tube) or the 10 yen or 50 yen coin auxiliary tube (C tube) shown in FIG. 1. If an A tube transfer solenoid coil 141 and a B tube transfer solenoid coil 142 (to be described later) are not energized, the coins are paid out from the 50 yen coin main tube (B tube).

A coin payout actuator interlocked with the coin payout motor $M_{01}$ is provided with a carrier switch 143 for the motor $M_{01}$ so that when the actuator is rotated by the coin payout motor $M_{01}$ the carrier switch 143 is turned on whereas when the coin payout actuator completes one revolution to terminate payout of the coins the switch 143 is turned off.

The off operation of the carrier switch 143 for the motor $M_{01}$ is detected by a detector 144 and its output "1" is applied to one input of an AND gate circuit 146 via an OR gate circuit 145. The other input of the AND gate circuit 146 is connected to receive the output of an AND gate circuit 147 via a AND gate circuit 148, and to the inputs of the AND gate circuit 147 are applied the outputs of the OR gate circuit 120, the flip-flop 118 and timer 119 so that the AND gate circuit 147 is enabled when the timer 119 operates. The other input of the AND gate circuit 148 is connected to receive the inverted signal of output of the escrow flip-flop circuit 113 so that the AND gate circuit 148 is enabled when the flip-flop 113 is reset.

Accordingly, the AND gate circuit 146 is enabled when the carrier switch 143 for motor $M_{01}$ is turned off while the timer 119 is operating to apply signal "1" to the reset terminal of the flip-flop 138 via an OR gate circuit 149 whereby the flip-flop 138 is reset and the coin payout motor $M_{01}$ is stopped.

A coin payout detector 150 for detecting paid out coins is provided at the coin payout opening (FIG. 1) and when the fact that the coin paid out by the operation of the coin payout motor $M_{01}$ has passed through the coin payout opening is confirmed, the detector 150 applies a signal "1" to one input of an AND gate circuit 151. The other input thereof is connected to receive the output of the AND gate circuit 148 which is enabled when the timer 119 is operating and when the escrow flip-flop 113 is reset.

As a consequence, the AND gate circuit 151 is enabled to apply signal "1" to a flip-flop 152 for holding the coin payout confirmation signal thereby setting the flip-flop 152. When this flip-flop 152 is set its set output "1" is applied to one input of an AND gate circuit 201 via an OR gate circuit 200. To the other input of the AND gate circuit 201 is applied the output signal "1" of an AND gate circuit 161 which is enabled when the delay time of the timer 119 terminates so that the AND gate circuit 201 is enabled when the timer 119 completes its operation to apply signal "1" to the reset terminal of a lock signal holding flip-flop 165 thus resetting the same. The output signal "1" from the OR gate circuit 200 is applied to one input of an AND gate circuit 203 via an OR gate circuit 202.

In the same manner as above described, since the other input of the AND gate circuit 203 is supplied with the output of the AND gate circuit 161, the AND gate circuit 203 is enabled when the time delay operation of the timer 119 completes so as to apply its output signal "1" to counter 1410 via an OR gate circuit 204 thus resetting the counter 1410.

The building up of the set output of the coin payout confirmation signal holding flip-flop 152 is detected by a build-up detector 153 which applies signal "1" to one input of an AND gate circuit 154. The other input of this AND gate circuit 154 is supplied with the output signal "1" of AND gate circuit 148 which is enabled while the timer 119 is operating. Under these conditions the AND gate circuit 154 is enabled to apply its output signal "1" to one input of an AND gate circuit 155 with its other input connected to receive the inverted signal of output of the comparator 136 which produces signal "1" when the counter $R_B$ of the 50 yen coin counter 30 becomes zero. At this time, since the vending machine is operating in the coin returning mode, $R_B \neq 0$ when 50 yen coin has been inserted so that the AND gate circuit 155 is enabled to apply signal "1" to the 50 yen coin counter count down commanding circuit 156.

Upon receipt of the signal "1", this commanding circuit 156 applies one pulse to the 50 yen coin counter 30 thus subtracting 50 from the count $R_B$ of the 50 yen coin counter 30 (the subtraction line is not shown).

The output of the ANd gate circuit 155 is applied to one input of a AND gate circuit 157 and the other input thereof is connected to receive the inverted signal of output of the comparator 158 which produces an output "1" when the count $R_{BN}$ of the stored 50 yen coin counter 33 reduces to zero. Under these conditions, the AND gate circuit 157 is enabled to apply its output signal "1" to a 50 yen coin counter count down commanding circuit 159.

This commanding circuit 159 has a construction identical to that of the commanding circuit 156 so that when signal "1" is applied the commanding circuit 159 applies one pulse to the stored 50 yen coin counter 33 so as to subtract 1 (one) from the count $R_{BN}$ thereof (the subtraction signal line is not shown).

In this manner, one 50 yen coin is paid out, 50 is subtracted from the count $R_B$ of the 50 yen coin counter 30 and one is subtracted from the count $R_{BN}$ of the stored 50 yen coin counter 33. However, since the operating time $t_3$ of the timer 119 is selected to be longer than the time necessary to perform these operations, when these operations are executed normally, they terminate within the operating time $t_3$ of the timer 119.

When the operating time $t_3$ elapses, the AND gate circuit 160 is enabled which is applied with the outputs of the NOR gate circuit 120, flip-flop 118 and the timer 119, and the output signal "1" from the AND gate circuit 160 is applied to one input of an AND gate circuit 161. Then this AND gate circuit 161 is enabled because its input is applied with the inverted signal of output of the escrow flip-flop 113 so that signal "1" is applied to the reset terminal of the coin payout confirmation signal holding flip-flop 152 thus resetting the same. At the same time, the output signal "1" from the AND gate circuit 161 is applied to the reset terminal of flip-flop 118 via the OR gate circuit 131 thus resetting the flip-flop. This signal "1" is also applied to the set terminal of the flip-flop 130 via the OR gate circuit 129 whereby the flip-flop 130 is set. Then the operation of the timer 121 is started again.

When the operation time $t_2$ of the timer 121 elapses the AND gate circuit 133 is enabled again so that its output sets the flip-flop 138 via AND gate circuits 134 and 135 and OR gate circuit 137 wherein one 50 yen coin is paid out by the operation simiar to that described above. This payout operation of the 50 yen coins is continued until the count $R_B$ of the 50 yen coin counter 30 reduces to zero.

If the coin payout motor $M_{01}$ is rotated under a condition of $R_b \neq 0$, and yet the carrier switch 143 for the motor $M_{01}$ is not open this means that a coin has been caught by the coin payout actuator. This problem is solved in the following manner. Thus, the output of the AND gate circuit 162 whose inputs are connected to receive the outputs of the 10 yen coin carrier switch, and flip-flop 138 is applied to one input of an AND gate circuit 164 via an OR gate circuit 163, and the other input of the AND gate circuit 164 is supplied with the output of the AND gate circuit 134.

Consequently, when the coin payout motor $M_{01}$ has been rotated but the carrier switch 143 for the motor $M_{01}$ does not open during the operating time of timer 119 and when the operating time $t_2$ of the timer 121 elapses, the AND gate circuit 134 is enabled again. Furthermore, when the carrier switch 143 for motor $M_{01}$ is in the closed state when the flip-flop 138 is set the AND gate circuit 164 is enabled to apply signal "1" to the lock signal holding flip-flop 166 thus setting the same. The set output "1" from the flip-flop 166 is applied to a reverse commanding circuit 167 which commands the reverse operations of the motors $M_{01}$ and $M_{02}$. At this time the coin payout motor $M_{01}$ is reversed.

The output of the flip-flop 138 is applied to one input of the AND gate circuit 140 via the OR gate circuit 139 and the other input of the AND gate circuit 140 is applied with the output of the AND gate circuit 134 so that the AND gate circuit 140 is enabled to apply an output signal "1" to counter 1410 to increase the count by one. The output signal "1" of the AND gate circuit 1410 is also applied to the set terminal of flip-flop 118 via the OR gate circuit 117. Thus the flip-flop 118 is set to start the operation of the timer 119. Since the counter 1410 has been counted up by 1 count in the preceding normal rotation, the contents of the counter 1410 becomes 2 by counting up of 1 count due to this reverse rotation.

As the timing operation of the timer 119 terminates, the AND gate circuit 161 is enabled so that the flip-flop 138 is reset by the output of the AND gate circuit 164 via the OR gate circuit 149. Consequently, the timer 121 is started and when this timer completes its operation the flip-flop circuit 138 is set via AND gate circuit 133, 134 and 135 the OR gate circuit 137 thus rotating the coin payout motor $M_{01}$ in the forward direction.

Accordingly, a coin is paid out and when the coin payout detector 150 detects such payout a confirmation signal "1" is applied therefrom to the set terminal of a coin payout confirmation signal holding flip-flop 152 via AND gate circuit 151 thus setting the same. The set output "1" from this flip-flop 152 is applied to the reset terminal of the counter 1410 via OR gate circuit 200 and 202. AND gate circuit 203 and OR gate circuit 204 thus resetting the counter. The set output "1" from the flip-flop 152 is also applied to the reset terminal of the lock signal holding flip-flop 165 via OR gate circuit 200 and gate circuit 201 thus resetting the same. Thereafter, 50 yen coins are paid out normally in the same manner as above described.

However, when the coin payout confirmation signal holding flip-flop 152 is not set because any coin has not been paid out inexpective of the reverse and forward rotation of the coin payout motor $M_{01}$, when the operation of the timer 119 terminates during the last forward rotation of the motor, then the timer is started and when its operaton terminates, the count of the counter 1410 becomes 3. Since this counter is constructed to produce a signal "1" when its count reaches 3, this signal will be applied to one input of AND gate circuit 169 via OR gate circuit 168.

Since the outputs of the OR gate circuit 120 the timer 119 and the flip-flop 118 are applied to the inputs of an AND gate circuit 170, the AND circuit 170 is enabled when the timing operation of the timer 119 terminates for applying its output to the input of a AND gate circuit 171 together with the inverted signal of output of the escrow flip-flop 113 and the inverted signal of output of the coin payout confirmation signal holding flip-flop 152. The AND gate circuit 171 is enabled when the payout of the coin is not confirmed at the time of termination of the operation of the timer 119 thereby applying signal "1" to one input of an AND gate circuit 172.

The other input of the AND gate circuit 172 is applied with the inverted signal of output "1" of the comparator 136 which produces a output "1" when $R_B=0$ so that the AND gate circuit 172 is enabled when $R_B \neq 0$. The "1" output from the AND gate circuit 172 is applied to one input of the AND gate circuit 169.

Consequently, AND gate circuit 169 is enabled when the count of the counter 1410 becomes 3 and when no 50 yen coin is paid out during the timing operation of the timer 119, and the output signal "1" from the AND gate circuit 169 is applied to the set terminal of the flip-flop 173 thus setting the same. This output signal "1" is also applied to the 50 yen→10 yen transfer commanding circuit 175 via a OR gate circuit 174.

The 50 yen →10 yen transfer commanding circuit 175 applies to the 50 yen coin counter 30 pulse signals of the number corresponding to the count $R_B$ thereof via line 176 and the OR gate circuit 27 thus reducing the count $R_B$ to zero. Further, the 50 yen→10 yen transfer commanding circuits 175 applies to the 10 yen coin counter 29 pulse signals of the number corresponding to the count $R_B$ of the 50 yen coin counter 30 via line 177 and the OR gate circuit 26 thus changing the count $R_A$ of the 10 yen coin counter 20 to $R_A+R_B$.

In this manner, the count $R_B$ of the 50 yen coin counter 30 is transferred to the count $R_A$ of the 10 yen coin counter 29 thus reducing the count $R_B$ to zero. At the same time, the output "1" of the counter 1410 is applied to the reset terminal of the lock signal holding flip-flop 165 via OR gate circuit 200 and AND gate circuit 201 thereby resetting the same. At the same time, the output from the OR gate circuit 200 is applied to the reset terminal of counter 1410 via OR gate circuit 202, AND gate circuit 203 and OR gate circuit 204 thus resetting the counter 1410.

When 50 yen coins of the number equal to that of the inserted 50 yen coins are paid out or when the count $R_B$ is transferred to count $R_A$ by the operation of the 50 yen→10 yen transfer commanding circuit 175 the count $R_B$ is reduced to zero, the AND gate circuit 179 is enabled since the inputs thereof are applied with the outputs of the AND gate circuit 134 and the comparator 136, as well as the inverted output signal of the comparator 178 which produces signal "1" when $R_A=0$. Thereafter, payout of the 10 yen coins is commenced.

The output signal "1" of the AND gate circuit 179 is applied to one input of an AND gate circuit 180, and the output of an AND gate circuit 181 and the inverted output signal of an AND gate circuit 182 are applied to the other inputs of the AND gate circuit 180.

Although the operation of the AND gate circuits 181 and 182 will be described later in connection with the change payout operation, it is now assumed that their outputs are "0". Accordingly, the AND gate circuit 180 is enabled to apply signal "1" to the set terminal of the flip-flop 184, thus setting the same.

The set output "1" of the flip-flop 184 is applied to an A tube transfer solenoid coil 141 via an AND gate circuit 1840 whose inputs are supplied with the output of flip-flop circuit 184 and an inverted signal of output of flip-flop circuit 199. The purpose of the A tube transfer solenoid coil 141 is to perform switching between the 50 yen coin main tube (B tube) the 10 yen coin main tube (A tube) and when it is energized it transfers the 50 yen coin main tube (B tube) to the 10 yen coin main tube (A tube) by operating the coin payout motor $M_{01}$.

The output signal "1" of the AND gate circuit 179 is also applied to one input of an AND gate circuit 185 and the other input thereof is applied with the inverted signal of output ("0") of the AND gate circuit 181 so that the AND gate circuit 185 is enabled whereby a signal "1" is applied to the set terminal of the flip-flop 138 via the OR gate circuit 137 whereby the flip-flop circuit 138 is set. Then its set output "1" is applied to the coin payout motor $M_{01}$ so that the motor is rotated to payout 10 yen coins from the 10 yen coin main tube (A tube) is in the same manner as the payout of the 50 yen coins.

More particularly, the carrier switch 143 for the coin payout motor $M_{01}$ become open and when this open state is detected by the detector 144, the detector 144 applies signal "1" to the reset terminal of the flip-flop 138 via OR gate circuit 145 and AND gate circuit 146 whereby the flip-flop 138 is reset to stop the coin payout motor $M_{01}$. Accordingly, one 10 yen coin is paid out.

The coin payout confirmation signal from the coin payout detector 150 is applied to the set terminal of the coin payout confirmation signal holding flip-flop 152 via AND gate circuit 151, so that the flip-flop 152 is set and the building up of its set output is detected by the build up detector 153 and its output "1" is applied to one input of a AND gate circuit 186 via the AND gate circuit 154.

The other inputs of the AND gate circuit 186 is supplied with the output ($R_{BN}=0$) of the comparator 158 and the inverted signal of output ($R_A=0$) of the comparator 178 so that the AND gate circuit 186 is enabled when $R_{BN}=0$ and $R_A\neq 0$ for applying its output "1" to the 10 yen coin counter count down commanding circuit 187 whereby 10 is subtracted from the count $R_A$ of the 10 yen coin counter 29. The output of the AND gate circuit 186 is applied to one input of an AND gate circuit 189. The other input of the AND gate circuit 189 is applied with the inverted signal of output of a comparator 190 which produces signal "1" when the count $R_{AN}$ of the stored 10 yen coin counter 32 becomes zero. At this time, since $R_{AN}\neq 0$ the AND gate circuit 189 is enabled to apply its output signal "1" to the 10 yen coin counter count down commanding circuit 191 whereby one is subtracted from the count $R_{AN}$ of the stored 10 yen coin counter 32.

As a consequence, the payout operation of one 10 yen coin completes. The payout operation of the 10 yen coins is continued until the count $R_A$ of the 10 yen coin counter 29 is reduced to zero and the output from the comparator 178 becomes "1".

In this manner, 100 yen, 50 yen and 10 yen coins of the same number as the inserted 100 yen, 50 yen and 10 yen coins are returned. When a 10 yen coin comes to be caught in the actuator during the payout operation of the 10 yen coins so that the carrier switch 143 can not open, the reverse commanding circuit 167 is operated in the same manner as above described to reverse the coin payout motor $M_{01}$. Even when three operations of forward, reverse and forward are performed it is impossible to confirm the payout of a 10 yen coin a signal "1" indicating a fault is applied to a stopping device 194 in the following manner.

More particularly, when the count of the counter 1410 becomes 3 its output "1" is applied to one input of AND gate circuit 192. Since the other inputs of this AND gate circuit 192 are supplied with the output of an AND gate circuit 193 having inputs connected to receive the output of AND gate circuit 171 which is enabled when the operation of the timer 119 terminates, a signal representing that $R_A\neq 0$, and a signal representing that $R_B=0$, and a signal representing that the A tube has been selected as the payout tube (this signal is equal to the output of the AND gate circuit 180) the AND gate circuit 192 is enabled thereby applying signal "1" to the stopping device 194 via OR gate circuit 193. Application of the signal "1" to the stopping device means a fault so that the vending operation of the automatic vending machine is stopped.

During the return operation, only the 10 yen coin main tube (A tube) and the 50 yen coin main tube (B tube) are operated and the auxiliary tubes (C and D tubes) are not used.

The change payout operation will now be described.

Change Payout Operation

Assume now that an article is purchased, that the coin collection operation has completed, that the clear button has been depressed and that signal "1" has been stored in the change payout commanding circuit 75, the change corresponding to the counts $R_A$, $R_B$ and $R_C$ of the 10 yen coin counter 29, the 50 yen coin counter 30 and the 100 yen coin counter 31 respectively, is paid out.

Payout of the change is started from the 100 yen coins. Since all 100 yen coins which are being held after completion of the coin collection operation should be paid out as the change, the 100 yen coins that has been held are paid out in the same manner as the coin returning operation described above.

More particularly, signal "1" from the change payout commanding circuit 75 and a signal on line 90 representing the completion of the coin collecting operation are applied to the inputs of AND gate circuit 1750.

This AND gate circuit is enabled simultaneously with the completion of the coin collecting operation to apply signal "1" to the set terminal of the escrow flip-flop 113 thus setting the same. The set output of the escrow flip-flop 113 is applied to the escrow solenoid coil 114 for returning all 100 yen coins that have been held.

The signal "1" from the change payout commanding circuit 75 turns the 10 yen, 50 yen and 100 yen coin counters 29, 30 and 31 to the count down mode via line OR circuit 115. At the same, this signal "1" is applied to the set terminal the flip-flop 118 via a line 116 and OR circuit 117 thus setting the same. As a consequence, the timer 119 is started.

When the timer 119 starts, the AND gate circuit 122 is enabled thereby applying signal "1" to the 100 yen coin counter count down commanding circuit 124 via the AND gate circuit 123. As a consequence, the count $R_C$ of the 100 yen coin counter 31 is reduced to zero. Then, the payout operation of the 100 yen coins completes. Then, the payout operations of the 50 yen and 100 yen coins are performed.

As an example, the case wherein the C tube is used as the auxiliary tube for 50 yen coins will be considered hereunder. In this case, the C tube transfer signal D.B.T. applied from terminal $T_9$ is "1".

The payout of the 50 yen coins is made with preference to the main tube (B tube) and where the count $R_{BN}$ of the stored 50 yen coin counter 33 is not equal to zero the same operation as the aforementioned coin returning operation is performed in the following manner.

When the 100 yen coins are paid out by the energization of the escrow solenoid coil 179 and when the operation time $t_3$ of the timer 119 elapses, signal "1" is applied to the reset terminal of the escrow flip-flop 113 via AND gate circuit 126, 127 and 128 thus resetting the same. At the same time the signal on line 128 is applied to the reset terminal of the flip-flop 118, via the OR gate circuit 131. This signal is also applied to the set terminal of the flip-flop 130, thus setting the same. When the flip-flop 130 is set, the operation of the timer 121 is started. When the operation time $t_2$ of the timer 121 elapses, the AND gate circuit 133 is enabled to apply signal "1" to the set terminal of the flip-flop 138 via AND gate circuits 134 and 135 and OR gate circuit 137.

When the flip-flop 138 is set, the coin payout motor $M_{01}$ is started. The output "1" of the flip-flop 138 is applied to the counter 1410 via OR gate circuit 139 and AND gate circuit 140 has changing its count to one. The output "1" of AND gate circuit 140 is also applied to the set terminal of the flip-flop 118 via the OR gate circuit 117 and this flip-flop is set for starting the timer 119.

By the rotation of the coin payout motor $M_{01}$ the 50 yen coins are paid out and the carrier switch 143 for the motor $M_{01}$ is ON-OFF controlled and when the off state of the switch is detected by the detector 144, the signal "1" produced thereby is applied to the flip-flop 138 via OR gate circuit 145, AND gate circuit 146 and OR gate circuit 149. Thus, the flip-flop 138 is reset to stop the coin payout motor.

When the coin payout detector 150 confirms that the coin has been paid out, signal "1" is applied to the flip-flop 152 via a AND gate circuit 151 to set the same.

The building up of the set output of the flip-flop 150 is detected by the build up detector 153 and its output signal "1" is applied to the 50 yen coin counter count down commanding circuit 156 via AND gate circuit 154 and 155, whereby the count $R_B$ of the 50 yen coin counter 30 is subtracted by 50. The output of the AND gate circuit 155 functions to subtract one from the count $R_{BN}$ of the stored 50 yen coin counter 159.

The operation described above continues until the count $R_B$ of the 50 yen coin counter 30 reduces to zero and the payout operation of the 50 yen coins terminates when $R_B=0$.

During the payout operation of the 50 yen coins, if a coin is caught by the coin payout actuator the AND gate circuit 162 will be enabled to apply signal "1" to the flip-flop 166 via OR gate circuit 163 and AND gate circuit 164 for setting it. Accordingly, the coin payout motor $M_{01}$ is rotated in the reverse direction and then in the forward direction.

When the coins are paid out by the forward, reverse or forward rotations of the coin payout motor $M_{01}$, the set output of the flip-flop 152 is applied to the reset terminal of the counter 1410 via OR gate circuits 200 and 202, AND gate circuit 203 and OR gate circuit 204 to clear the content of the counter 1410. In this manner, 50 yen coins are paid out in the same manner as above described but if the coins are not paid out so that the count of the counter 1410 becomes 3, signal "1" is produced by the counter 1410 and this signal is applied to the 50 yen→10 yen transfer commanding circuit 175 via OR gate circuit 168, AND gate circuit 169 and OR gate circuit 174 whereby the content $R_B$ of the 50 yen coins counter 30 is changed to zero and the count $R_A$ of the 10 yen coin counter 29 is changed to $R_A+R_B$.

It is assumed now that the count $R_{BN}$ of the stored 50 yen coin counter 33 is zero.

The signal "1" stored in the change payout commanding circuit 75 is applied to the flip-flop 197 through line 196 so that this flip-flop is set, and its set output "1" is applied to one input of AND gate circuit 198. To the other inputs of this AND gate circuit 198 are applied the output from the AND gate circuit 135 which is enabled when the operation of the timer 121 terminates, the transfer signal D.B.T. (in this case "1") from terminal $T_9$, the output of the comparator 158 which shows that $R_{BN}=0$, and the inverted output signal of the C tube vacant signal holding flip-flop 19. Accordingly, the AND gate circuit 198 is enabled when $R_{BN}=0$, when the C tube is not vacant and when the operation of the timer 121 terminates to apply signal "1" to the flip-flop 199 via OR gate circuit 183 thus setting the flip-flop 199.

The set output of the flip-flop 199 is applied to the C tube transfer solenoid coil 142 through the AND gate circuit 1990 having the input applied with the inverted signal of output of the flip-flop circuit 184 thus switching the coil payout tube to the C tube.

When the timing operation of the timer 121 terminates, the AND gate circuit 133 is enabled to apply signal "1" to the flip-flop 138 via AND gate circuits 134 and 135 and OR gate circuit 137 to set the flip-flop 138. Then, the coin payout motor $M_{01}$ is rotated to payout 50 yen coins from the C tube.

This payout operation is performed in the same manne as above described and each time one 50 yen coin is paid out 50 is subtracted from the count $R_B$ of the 50 yen coin counter 30 and one is subtracted from the count $R_{BN}$ of the stored 50 yen coin counter 33.

In this manner, 50 yen coins are continuously paid out from C tube until $R_B$ becomes zero. Suppose now that no 50 yen coin was paid out from C tube by the rotation of the coin payout motor $M_{01}$ under the condition of $R_B \neq 0$.

Under these conditions, if a paid out coin were not caught the output of the flip-flop 169, the output of the comparator 158 representing that $R_{BN}=0$ and the inverted signal of output of the lock signal holding flip-flop 165 are applied to the inputs of AND gate circuit 205 to enable the same so that signal "1" is applied to one input of the AND gate circuit 169 via OR gate circuit 168. To the other input of the AND gate circuit 169 is applied the output of the AND gate circuit 172 which shows that a coin was not paid out at the end of the operation of the timer 119 even under a condition of $R_B \neq 0$.

Accordingly, the AND gate circuit 169 is enabled at the end of the operation of the timer 119 for applying signal "1" to the flip-flop 173 so as to set the same. At the same time, the signal "1" is also applied to the 50 yen→10 yen transfer commanding circuit 175 via OR gate circuit 174 to change the count $R_B$ of the 50 yen coin counter 30 to zero and to transfer this value to the count $R_A$ of the 10 yen coin counter 29.

The output signal "1" from the AND gate circuit 169 is applied to the reset terminal of the counter 1410 via OR gate circuit 204 to clear the counter 1410. At the same time, this signal "1" is applied to the reset terminal of the flip-flop 197 via OR gate circuit 206 to reset the same.

At this time, since the output of the flip-flop 197 the output of the comparator 158 showing that $R_{BN}=0$, signal D.B.T. showing that C tube is used as the 50 yen coin tube and a signal from OR gate circuit. 208 showing that the lock signal holding flip-flop 165 is not set, are applied to the AND gate circuit 207, this AND gate circuit 207 is enabled to apply signal "1" to one input of an AND gate circuit 209. The outer input of the AND gate circuit 209 is supplied with the inverted signal of output of the flip-flop 19 for holding the C tube vacant signal.

Since it was assumed that the flip-flop 19 has not been set, the AND gate circuit 209 is enabled to apply signal "1" to the set terminal of the C tube vacant signal holding flip-flop 19 via OR gate circuit 201 210 thus setting the flip-flop 19.

When 50 yen coins are paid out while the C tube vacant signal holding flip-flop 19 is being set the AND gate circuit 198 will not be enabled and then the C tube transfer solenoid coil 142 will not also be energized, as the coin payout motor $M_{01}$ is rotated due to the setting of the flip-flop 138, 50 yen coins are paid out from B tube.

During the payout operation of the 50 yen coins from the B tube, if the lock signal holding flip-flop 165 were not set under the condition of $R_B \neq 0$, and the coin payout confirmation signal holding flip-flop 152 were not set at the end of the operation of the timer 119, the AND gate circuit 169 will be enabled whereby the flip-flop 173 is set in the same manner as above described to operate the 50 yen→10 yen transfer commanding circuit 175 to change count $R_B$ to count $R_A$.

Under these circumstances although the AND gate circuit 207 is enabled since at this time the C tube vacant signal holding flip-flop 19 has been set the AND gate circuit 211 is enabled because its inputs are supplied with the outputs of the AND gate circuit 207 and the flip-flop 19. As a consequence, signal "1" is applied to the reset terminal of the C tube vacant signal holding flip-flop 19 via OR gate circuit 212 thus resetting the flip-flop 19.

Suppose now that at the time of starting the payout of the 50 yen coins $R_B=0$ and $R_{BN}=0$ and that flip-flop 173 has been set then the AND gate circuit 213 with its inputs supplied with the output of the AND gate circuit 123, The inverted signal of output ($R_B=0$) of the comparator 136, and the output ($R_{BN}=0$) of the comparator 158, is enabled. The output signal "1" of the AND gate circuit 213 is applied to the reset terminal of the flip-flop 173 via an OR gate circuit 300 thus resetting the flip-flop 173. At the same time, the output signal "1" from the flip-flop 173 is applied to the 50 yen→10 yen transfer commanding circuit 175 to change the count $R_B$ to count $R_A$ and to change the count $R_B$ to zero.

In this manner, when the count $R_B$ of the 50 yen coin counter 30 is reduced to zero the payout operation of 50 yen coins is completed and then payout of the 10 yen coins is performed.

Suppose now that $R_B=0$ and $R_A=0$, when the AND gate circuit 179 is enabled by the application of the output of the AND gate circuit 134, the output ($R_B=0$) of the comparator 136 and the inverted signal of output ($R_A \neq 0$) of the comparator 178, the payout of the 10 yen coins are commenced.

The output signal "1" of the AND gate circuit 179 is applied to the set terminal of the flip-flop 184 via AND gate circuit 180 thus setting the flip-flop whereby the A tube transfer solenoid coil 141 is energized to select the A tube as the coin payout tube. Also the output signal "1" of the AND gate circuit 170 is applied to the set terminal of the flip-flop 138 via OR gate circuit 137 so as to set the flip-flop 138 to rotate the coin payout motor $M_{01}$. Consequently, 10 yen coins are paid out from A tube in the same manner as the payout operation of the 10 yen coins during the returning operation described above.

Suppose now that the count $R_{AN}$ of the stored 10 yen coin counter 32 is zero. In this case, the output of the flip-flop 197, the output ($R_{AN}=0$) of the comparator 190, and the inverted signal (a signal showing that the D tube is not separated) of output from the D tube separation signal holding flip-flop 20 are applied to the inputs so that the AND gate circuit 214 is enabled to apply signal "1" to one input of AND gate circuit 181. To the other input of the AND gate circuit 181 is applied via OR gate circuit 215 th signal D.B.T. from terminal $T_9$ showing that C tube is selected as the 50 yen coin tube. Consequently, the AND gate circuit 181 is enabled to apply signal "1" to an AND gate circuit 216. Since the output of the AND gate circuit 179 is applied to one input of the AND gate circuit 216, the AND gate circuit 216 is enabled at the end of the operation of the timer 121 to apply signal "1" to the set terminal of flip-flop circuit 217 thus setting the same. The set output of the flip-flop 217 is applied to the coin payout motor $M_{02}$ to start the same. The purpose of the coin payout motor $M_{02}$ is to payout 10 yen coins from the 10 yen coin auxiliary tube (D tube).

When the carrier switch 195 is opened and closed by the coin payout motor $M_{02}$, the opening of this switch is detected by the detector 218 and its output signal "1" is applied to the reset terminal of the flip-flop 217 via OR gate circuit 145, AND gate circuit 146 and OR gate circuit 219 to reset the flip-flop 217 thus stopping motor $M_{02}$.

By the operation described above one 10 yen coin is paid out and when the coin payout detector 150 detects such payout, a signal "1" is applied to the set terminal of the coin payout confirmation signal holding flip-flop 152 via AND gate circuit 151 thus setting the flip-flop 152.

The building up of the set output from the flip-flop 152 is detected by the build up detector 153 and its output signal "1" is applied to the 10 yen coin counter count down commanding circuit 187 via AND gate circuits 154 and 186 thereby subtracting 10 from RA, and the output from the AND gate circuit 186 is applied to the stored 10 yen coin counter count down commanding circuit 191 to subtract one from its count $R_{AN}$.

During the 10 yen coin payout operation from the D tube, notwithstanding of the rotation of the coin payout motor $M_{02}$, when the coin payout detector 150 does not confirm the coin payout and when the lock signal holding flip-flop 165 is not set, AND gate circuit 220 is enabled because its inputs are supplied with the output of the AND gate circuit 1930, the output of the OR gate circuit 208, and a signal showing that D tube has been selected as the coin payout tube (that is the output signal from AND gate circuit 216) so that signal "1" is applied to the reset input of the counter 1410 via OR gate circuit 204 for clearing the content of the counter 1410. At the same time, the signal "1" from the AND gate circuit 220 is applied to the reset terminal of flip-flop 197 via OR gate circuit 206 thus resetting the flip-flop circuit 197.

When the flip-flop 197 is reset, the AND gate circuit 214 is disenabled so that the AND gate circuit 180 is enabled when the AND gate circuit 179 is enabled. As a result, the flip-flop 184 is set to energize the A tube transfer solenoid coil 141 thereby selecting A tube as the coin payout tube. In the same manner as above described the remaining changes are paid out from tube A by the rotation of the coin payout motor $M_{01}$ and the change payout operation is completed when the count $R_A$ becomes zero.

Although in the foregoing description, C tube was selected as the 50 yen coin auxiliary tube, in an automatic vending machine which vends articles requiring a large number of 10 yen coins as the change it is possible to select the C tube as the 10 yen coin auxiliary tube. In this case, the signal D.B.T. applied to terminal $T_6$ is "0".

Consequently, during the payout operation of the 50 yen coins, if $R_{BN} \neq 0$, the AND gate circuit 135 would be enabled to set the flip-flop 138 via OR gate circuit 137 whereby the coin payout motor $M_{01}$ is rotated to payout 50 yen coins from B tube, in the same manner as above described. But if $R_{BN}=0$, the AND gate circuit 173 is enabled to apply signal "1" to the 50 yen→10 yen transfer commanding circuit 175 via OR gate circuit 174 to change the count $R_B$ to $R_A$.

During the payout operation of the 10 yen coins if $R_{AN} \neq 0$, the output "1" of the AND gate circuit 179 is applied to the flip-flop 184 via AND gate circuit 180. Consequently, the flip-flop 184 is set to energize the A tube transfer solenoid coil 141 thus paying out 10 yen coins from A tube. Where $R_{AN}=0$ and the C tube vacant signal holding flip-flop 19 were not set, AND gate circuit 221 will be enabled since its inputs are supplied with the output of the flip-flop 197, the output ($R_{AN}=0$) of the comparator 190, and the inverted signal of D.B.T. from terminal $T_9$, thus applying signal "1" to one input of the AND gate circuit 182. To the other input thereof is applied the output of the C tube vacant signal holding flip-flop 19 via OR gate circuit 222. Accordingly, the AND gate circuit 182 is enabled to apply signal "1" to one input of an AND gate circuit 223.

Since the inverted signal of the output of the AND gate circuit 181 and the output of the AND gate circuit 179 are applied to the other inputs of the AND gate circuit 223 this AND gate circuit 179 is enabled and its output changes to "1". This "1" output is applied to the set terminal of flip-flop 199 via OR gate circuit 183. Consequently, the flip-flop 199 is set to energize the C tube transfer solenoid coil 142 for transferring the payout operation to the C tube.

Consequently, as the coin payout motor $M_{01}$ rotates, 10 yen coins are paid out from C tube. Suppose now that regardless of the rotation of the coin payout motor $M_{01}$ the detector 150 does not detect the payout of the coin so that the coin payout confirmation signal holding flip-flop 152 is not set.

Under these conditions, since the inputs of the AND gate circuit 224 are supplied with the output of the lock signal holding flip-flop 165 via OR gate circuit 208, the output of the AND gate circuit 1930 and a signal showing that the C tube has been selected as the coin payout tube, the AND gate circuit 224 is enabled to apply signal "1" to the reset terminal of counter 1410 via OR gate circuit 204 thus resetting the counter 1410. At the same time, the signal "1" from the AND gate circuit 224 is applied to the reset terminal of the flip-flop 197 via OR gate circuit 206 thus resetting the flip-flop 197.

When the flip-flop 197 is reset, the AND gate circuit 221 is disenabled so that the output from AND gate circuit 223 becomes "0". At this time, however, the AND gate circuit 180 is enabled to apply a signal "1" to the set terminal of the flip-flop 184 to set the same. As a consequence, the A tube transfer solenoid coil 141 is energized to payout the change from A tube.

Assume now that the C tube vacant signal holding flip-flop 19 is set and that the D tube separation signal holding flip-flop 20 is reset.

Under these conditions, since the outputs of the AND gate circuit 214 and the OR gate circuit 215 are applied to the input of the AND gate circuit 181, this AND gate circuit 181 is enabled to apply signal "1" to the set terminal of the flip-flop 217 via AND gate circuit 216. Consequently, the coin payout motor $M_{02}$ is energized to payout 10 yen coins from D tube.

In this case, too if payout of the coin is not confirmed regardless of the rotation of the motor $M_{02}$ the AND gate circuit 220 is enabled so that the payout tube is switched to A tube and the remaining change is paid out from A tube.

When the D tube separation signal holding flip-flop 20 is set and the C tube vacant detection signal holding flip-flop 19 is reset, the AND gate circuit 182 whose inputs are supplied with the outputs of the AND gate circuit 221 and the OR gate circuit 222 is enabled to switch the payout tube to C tube thereby paying out 10 yen coins from C tube. At this time too, when the C tube becomes empty, the AND gate circuit 224 is enabled so that the payout tube is switched to A tube and the remaining change is paid out from A tube.

The output from the AND gate circuit 225 whose input are applied with the inverted signal of output of the D tube separation signal holding flip-flop 20 and the output of the carrier switch 195 for the motor $M_{02}$, and the output of the carrier switch 143 for the motor $M_{01}$ are applied to the two inputs of the AND gate circuit 227 via OR gate circuit 226 and the remaining input of the AND gate circuit 227 is supplied with the inverted signal of output of the clock signal holding flip-flop 165.

Since the output of the AND gate circuit 227 is applied to one input of the AND gate circuit 203 via OR gate circuit 202, this AND gate circuit will be enabled when the outputs from carrier switches 143 and 195 do not decrease even though the lock signal holding flip-flop 165 is not set at the end of the operation of the timer 119 so as to apply signal "1" to the reset terminal of the counter 1410 via OR gate circuit 204, whereby the counter 1410 is cleared.

The output of the OR gate circuit 228 with its inputs supplied with the output of the flip-flop 166 and the inverted signal of output of the carrier switch 143, and the output of the AND gate circuit 229 whose input is supplied with the output of the flip-flop 138 are applied to the inputs of AND gate circuit 230. The other input of the AND gate circuit 230 is supplied with the output of AND gate circuit 161 which shows the end of the operation of the timer 119.

Consequently, at the end of the operation of the timer 119, the output of the carrier switch 143 is "0" so that the flip-flop 166 is set and when the flip-flop 138 is not set, the AND gate circuit 230 is enabled to apply signal "1" to the stop circuit 194 via the OR gate circuit 194 thus stopping the operation of the vending machine.

The output of the OR gate circuit 231 whose inputs are supplied with the output of the carrier switch 195, and the output of the flip-flop 166, and the output of the carrier switch 143 are applied to the AND gate circuit 232 whereby this AND gate circuit is enabled to apply its output to one input of AND gate circuit 233. Similar to the AND gate circuit 230, the other input of the AND gate circuit 233 is supplied with the output of the AND gate circuit 161 so that the AND gate circuit 233 is enabled when the flip-flop circuit 166 is set because the output of the carrier switch 195 is "0" at the end of the operation of the timer 119 and when the output of the carrier switch 143 is "1" that is the coin payout motor $M_{01}$ becomes inoperative. Then, signal "1" is applied to the set terminal of the D tube separation signal flip-flop 20 whereby the flip-flop 20 is set to inhibit payout of the coins from D tube.

What is claimed is:

1. In a method of controlling an automatic vending machine, wherein amounts of coins inserted into a vending machine are added together to obtain a sum, a vend price is subtracted from the sum to obtain amounts of the coins remaining in separate counters for the coins of each denomination, and the remaining amounts are paid out as the change, the improvement wherein, even though an amount of the higher denomination is remaining in the counter of said coins of the higher denomination, where it is impossible to pay out coins of the higher denomination, the amount remaining in the counter of said coins of the higher denomination is transferred to the count of the separate counter for the coins of the lower denomination for paying out the coins of the lower denomination.

2. A control system of an automatic vending machine comprising main coin storing means, coins stored therein being automatically supplemented by coins inserted into said vending machine, a counter circuit for adding the number of coins automatically supplemented and for subtracting the number of coins paid out from said main coin storing means, auxiliary coin storing means for storing coins of a predetermined denomination which are supplemented manually, means for paying out coins from said main coin storing means until the count of said counter circuit reaches a predetermined value, means for switching from said main coin storing means to said auxiliary coin storing means for paying out coins therefrom when the count of said counter circuit reaches said predetermined value, and means for switching from said auxiliary coin storing means back to said main coin storing means thus paying out coins therefrom when coins are not paid out from said auxiliary coin storing means irrespective of the operation thereof.

3. A control system for an automatic vending machine comprising:

a plurality of separate add/subtract counters, one for each of a plurality of different denominations of inserted coins, for counting inserted coins in accordance with their denominations;

a first comparing circuit for comparing the sum K of the counted values of said plurality of counters with a set vend price $R_{SP}$ to produce a vend signal when $K \geqq R_{SP}$;

a second comparing circuit for comparing the count $R_A$ of the lowest denomination coin counter with said set vend price $R_{SP}$ after vending;

first control means for causing said lowest denomination coin counter to subtract the set vend price $R_{SP}$ from said count $R_A$ when $R_A \geqq R_{SP}$;

second control means for causing the amount of one coin of a denomination one rank higher than the lowest denomination to be subtracted from the amount of the coin counter for said one rank higher denomination while causing the same amount to be added to the count of the lowest denomination coin counter when $R_A < R_{SP}$, and thereafter causing the amount of one coin of any of two or more ranks higher denomination than said lowest denomination to be subtracted from the count of the coin counter corresponding to said any of two or more ranks higher denomination while causing the same amount to be added to the count of the coin counter corresponding to said one rank higher denomination and subsequently to the count of the coin counter corresponding to the lowest denomination in the same manner as the previous subtraction and addition caused by said second control means until $R_A \geqq R_{SP}$, at which time the operation of said second control means stops;

third control means for operating said first control means when said second control means stops; and payout means for paying out the amount corresponding to the respective counted values of said different denomination coin counters in accordance with the corresponding denominations when depressing a clear button.

4. A control system according to claim 3, wherein said first comparing circuit compares the sum K with the set vend price $R_{SP}$ when said lowest denomination coin counter completes the subtraction caused by said first control means to prepare said machine for a repetition of its vending operation when a purchaser selects a further article to be vended.

5. A control system for an automatic vending machine comprising:

a plurality of storage tubes, each corresponding to a different coin denomination and each being supplied automatically with inserted coins of the denomination to which it corresponds;

a separate coin storage counter denominationally associated with each storage tube for adding the amount of coins inserted in the storage tube and subtracting the amount of coins paid out of the storage tube;

a plurality of separate auxiliary storage means, each corresponding to a different coin denomination and each being supplied manually with coins of the denomination to which it corresponds;

a first control circuit for normally paying out coins from said storage tubes; and a second control circuit for transferring the counting operation of each coin storage counter from its storage tube to the auxiliary storage means corresponding to the same coin denomination when the count of the coin storage counter becomes zero.

6. A control system according to claim 5, further comprising a motor, a coin payout mechanism connected in driven relationship with said motor and provided at the lower portions of said storage tubes, detecting means for detecting when a coin is not paid out from its corresponding storage tube when said payout mechanism is driven to pay out said coin, and a third control circuit responsive to the output of said detecting means for transferring payout from said corresponding storage tube to the auxiliary storage means for a coin of lower denomination.

7. A control system according to claim 6, further comprising a fourth control circuit for transferring payout from said auxiliary storage means to the storage tube of coin denomination corresponding to that of said auxiliary storage means when the coin is not paid out from the latter.

8. A control system according to claim 7, further comprising a memory circuit for storing an indication of no payment when a coin is not paid out from said auxiliary storage means, and a fifth control circuit for paying out the coin from the corresponding storage tube when the no payout indication is stored in said memory circuit.

9. A control system according to claim 5, wherein said auxiliary storage means includes a plurality of tubes, each for containing coins of a different denomination from the other and being used in the same sequence as the operation of the main storage tubes in converting to the lowest denomination to effect payment.

10. A control system according to claim 6, wherein said detecting means includes an AND circuit for producing an output only when said motor drives through one rotation and when a switch in the payout path of the coin is not operated by the coin.

11. A control system according to claim 10, further comprising a sixth control circuit for disengaging a coin jammed in the coin payout mechanism by alternatively driving said motor in its normal driving relationship with said mechanism and in a reverse driving relationship.

* * * * *